US010920479B2

(12) United States Patent
Dijkema et al.

(10) Patent No.: US 10,920,479 B2
(45) **Date of Patent: *Feb. 16, 2021**

(54) STORAGE SYSTEM

(71) Applicant: Vapensystems Inc., Lawrenceville, GA (US)

(72) Inventors: Martinus Dijkema, Lawrenceville, GA (US); Richard William Meier, Jr., Jupiter, FL (US)

(73) Assignee: VAPENSYSTEMS, INC, Lawrenceville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,112

(22) Filed: Sep. 19, 2019

(65) Prior Publication Data

US 2020/0024887 A1 Jan. 23, 2020

Related U.S. Application Data

(63) Continuation of application No. 14/731,968, filed on Jun. 5, 2015, now Pat. No. 10,422,178, which is a continuation of application No. 14/713,965, filed on May 15, 2015, now Pat. No. 10,094,161.

(51) Int. Cl.
*E05G 1/026* (2006.01)
*E05B 65/00* (2006.01)

(52) U.S. Cl.
CPC ..... *E05G 1/026* (2013.01); *E05B 65/0071* (2013.01); *E05B 65/0075* (2013.01)

(58) Field of Classification Search
CPC ..... E05G 1/026; E05G 1/04; E05G 1/024; E05G 7/007; E05B 65/0071; E05B 65/0075; F16D 63/006; F16D 2127/06; A47B 81/005; A47B 49/00; B65D 21/0233
USPC ..... 70/63; 109/6–10, 45, 48, 50–52, 59 R, 109/59 T, 71, 73; 49/35, 40; 188/265; 312/135, 305; 206/317; 224/912; 42/70.01, 70.11; 220/810, 825, 23.86, 220/23.89, 23.83
See application file for complete search history.

(56) References Cited

U.S. PATENT DOCUMENTS 126,133 A * 4/1872 Corliss
565,083 A * 8/1896 Lynne
616,705 A * 12/1898 Hall
961,227 A * 6/1910 Hattersley
(Continued)

*Primary Examiner* — Lloyd A Gall
(74) *Attorney, Agent, or Firm* — Robert Z. Evora, Esq.

(57) ABSTRACT

A storage system for securing a weapon or valuable item. The storage system has an outer housing assembly including an elongated housing, an arcuate housing door and a handle assembly. The elongated housing has a non-rotatable curved inner structure. The handle assembly rotates the arcuate housing door concentrically about a longitudinal axis and partially within and adjacent to the non-rotatable curved inner structure. A rotational pivot of the handle assembly is aligned with the longitudinal axis and rotates the arcuate housing door about the longitudinal axis between a closed position that prevents access to an internal compartment within the elongated housing, and an open position that provides an access opening of approximately 180 degrees about the longitudinal axis into the internal compartment within the elongated housing.

19 Claims, 29 Drawing Sheets

(56) References Cited

U.S. PATENT DOCUMENTS 1,196,081 A * 8/1916 Carence ..... B60S 1/0411 15/250.1
1,698,994 A * 1/1929 Hall ..... E05B 65/0071 70/282
1,842,531 A * 1/1932 Mariotti ..... E05G 1/024 312/33
1,961,250 A * 6/1934 Scheeler ..... E05G 1/026 109/19
2,512,622 A 5/1948 Fish
3,055,319 A * 9/1962 Asprion ..... E05G 7/007 109/12
3,188,159 A * 6/1965 Wenger ..... A47B 49/004 312/305
3,285,209 A * 11/1966 Pace ..... E06B 3/90 109/8
4,099,808 A 7/1978 Oakley et al.
4,158,999 A * 6/1979 Sukolics ..... E05G 7/007 109/19
4,475,465 A * 10/1984 Hastings ..... E05G 5/02 109/2
4,637,325 A * 1/1987 Hong ..... E05G 7/007 109/19
4,936,531 A 6/1990 Bauser
5,662,219 A * 9/1997 Tschudy ..... A45C 13/02 150/113
5,701,770 A * 12/1997 Cook ..... E05B 47/02 206/1.5
5,979,846 A 11/1999 Fluhr
6,865,993 B2 * 3/2005 Bartel ..... E05D 15/56 109/48
6,868,975 B2 3/2005 Sells et al.
7,137,511 B1 11/2006 Crowell et al.
7,748,545 B2 * 7/2010 Johnson ..... F17C 13/084 211/163
8,474,923 B2 7/2013 Pendleton et al.
8,820,188 B2 * 9/2014 Ho ..... F16D 63/006 192/219.4
8,839,937 B2 * 9/2014 Hazama ..... B60T 1/005 192/219.5
8,950,596 B2 2/2015 Arabian et al.
8,973,297 B2 3/2015 Boggess et al.
9,145,113 B2 * 9/2015 Landino ..... B60T 1/005
9,387,473 B2 * 7/2016 Hintikka ..... B01L 3/0217
10,094,161 B2 * 10/2018 Meier, Jr. ..... E05B 65/0075
10,422,178 B2 * 9/2019 Dijkema ..... E05G 1/026
2003/0188674 A1 * 10/2003 Bartel ..... E05D 15/56 109/70
2011/0162564 A1 * 7/2011 Heim ..... E05G 1/005 109/48
2011/0174199 A1 7/2011 Pendleton et al.
2013/0298807 A1 * 11/2013 Wall ..... E05G 1/024 109/38
2014/0345507 A1 * 11/2014 Pendleton ..... A47B 81/005 109/48

* cited by examiner

STORAGE SYSTEM

CROSS REFERENCE TO RELATED APPLICATION

This application is a Non-Provisional Application and claims priority to U.S. Non-Provisional application Ser. No. 14/713,965 filed May 15, 2015, now U.S. Pat. No. 10,094,161; and claims priority to U.S. Non-Provisional application Ser. No. 14/731,968 filed Jun. 5, 2015, now U.S. Pat. No. 10,422,178 the contents of all of which are hereby incorporated by reference herein in their entirety into this disclosure.

BACKGROUND

1. Technical Field

The invention relates to a storage system for securely housing various valuable items, and in particular to providing a two part storage system having a rotatable door with a locking mechanism to prevent rotation of the rotatable door from a locked to an unlocked position into which valuable items may be stored, such as a cassette securing various weapons and accessories that can be quickly disconnected and removed from the storage system for use remotely.

2. Description of the Related Art

Gun safes currently come in a variety of different sizes and shapes. Current gun safes are typically in the form of an upright, rectangular, metal box that include a rectangular door on the front of the box. Locking mechanisms used with these safes typically include numerous cylindrical metal bolts that slide into corresponding circular cutouts that are located contemporaneously close to the safe's door as the door is locked. Likewise, these conventional safes are cumbersome to use as the access door opening to insert and retrieve weapons from is narrow and oftentimes difficult to handle weapons there-through. Once open, withdrawing the various weapons from the safe in a quick manner is difficult and impossible with conventional designs.

Consequently, there is a need for a storage system with an improved locking mechanism having a large access door to secure various items, such as various weapons, their ammunition, magazines, and the like. Likewise, there is a need to be able to withdraw these various items from a safe in a quick and easy many.

SUMMARY

An object of the present invention is to provide a storage system having an outer housing assembly comprising an elongated housing having a curved inner structure and a cylindrical housing secured adjacent to the curved inner structure partially within the elongated housing. The cylindrical housing rotates between a closed position that prevents access to an internal compartment within the cylindrical housing, and an open position that provides an access opening of approximately 180 degrees into the internal compartment within the cylindrical housing.

A locking mechanism is provided in the outer housing of the storage system. The locking mechanism is adapted to prevent rotation, or permit rotation of the cylindrical housing in a locked position or an unlocked position respectively.

Where, in the locked position, the locking mechanism prevents the cylindrical housing from rotating into the open position.

These and other objects, features, and/or advantages may accrue from various aspects of embodiments of the present invention, as described in more detail below.

BRIEF DESCRIPTION OF THE DRAWINGS

Various exemplary embodiments will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
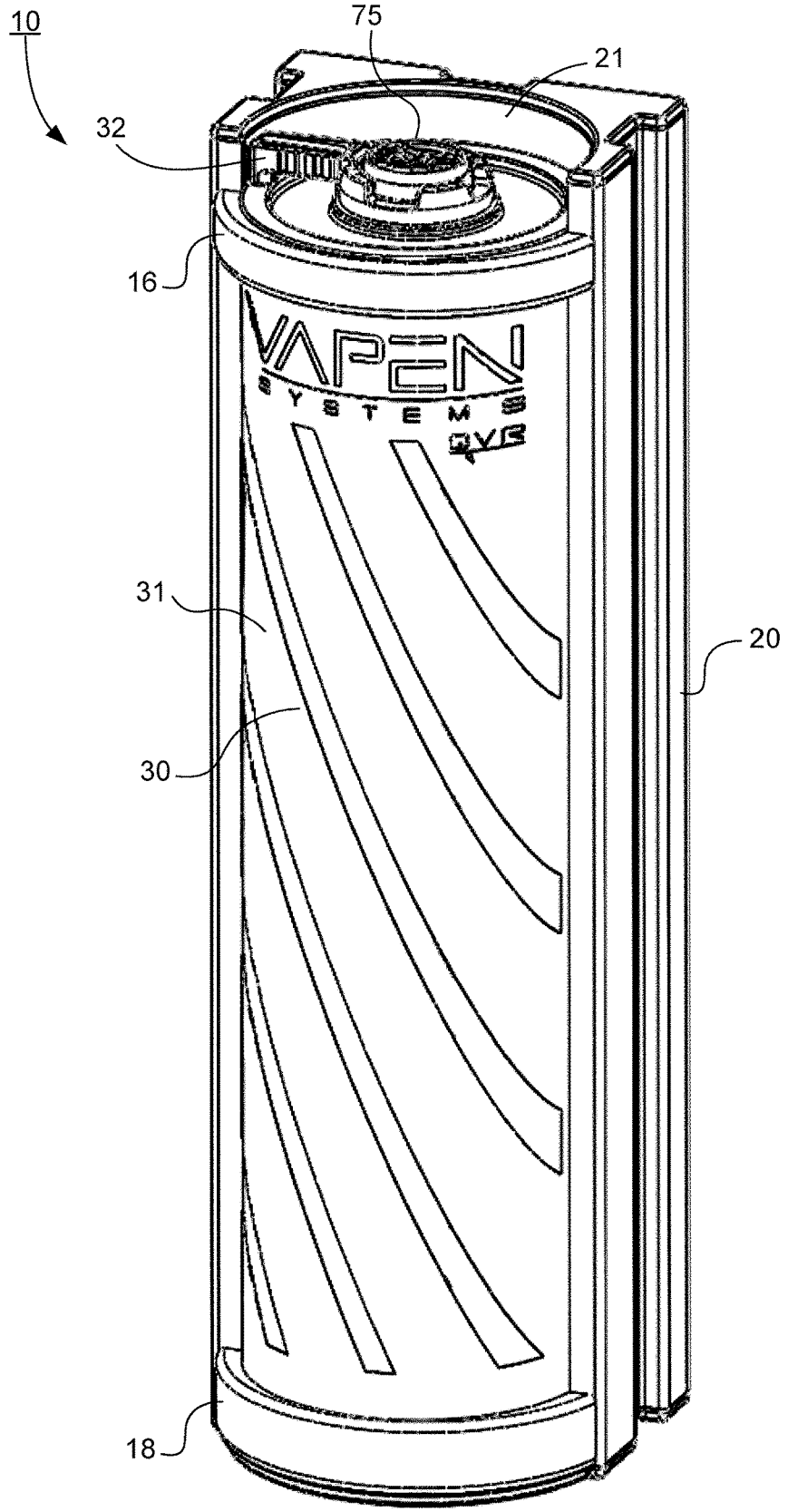
FIG. 1 illustrates an exemplary a weapons storage system in a closed locked position in accordance with this invention.

FIG. 1 illustrates an exemplary weapons storage system 10 according to this subject disclosure. Various advantages will be described below by the construction of the weapons storage system 10. The construction of the weapons storage system 10 provides for a large 180 degree access opening to an internal compartment in an unlocked open position. A locking mechanism may be positioned in a remote, hard to access, location within a lower assembly of the weapons storage system 10. A code input receiver, such as a keypad may be positioned atypically distant from the locking mechanism further ensuring the inability to break into the weapons storage system 10. Another advantage of the weapons storage system 10 is the ability to rapidly access weapons stored therein and to be able to quickly remove a weapons cassette from within the weapons storage system 10 and quickly move it to a remote location.

Figure 4:
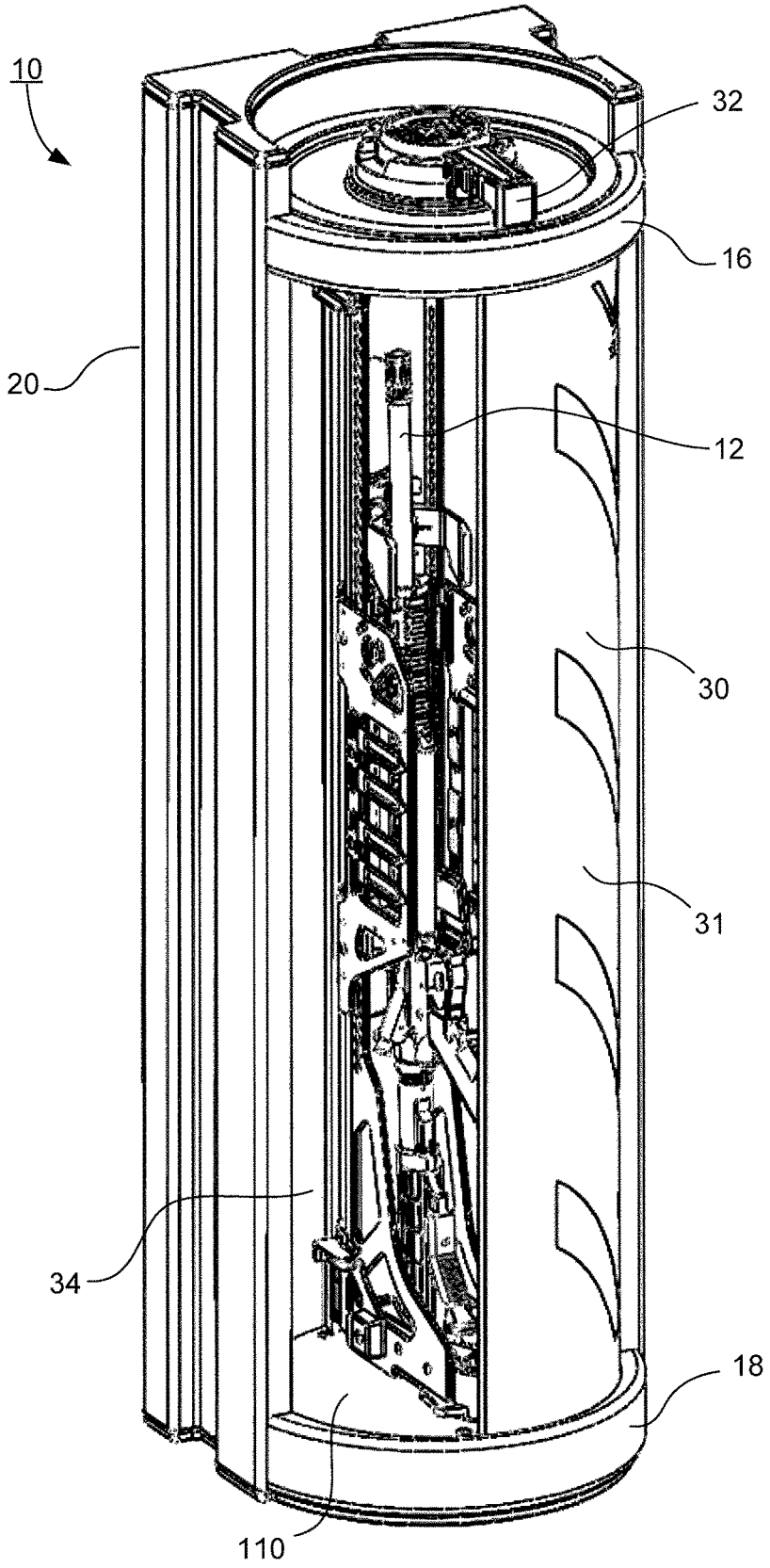
FIG. 4 illustrates the weapons storage system in a partial open position.

The weapons storage system 10 has an elongated upright tall profile. The weapons storage system 10 may have a rectangular outer base housing 20 bounded by a lower assembly 18 and a top assembly 16. The outer base housing 20 has an elongated curved inner structure 21. The rectangular outer base housing 20, the lower assembly 18 and the top assembly 16 all partially encase an integrated cylindrical shaped and an elongated upright inner secure rotatable housing 30. The inner secure rotatable housing 30 is rotated between an open position and a closed position by a handle 32 provided in the top assembly 16 at an upper end of the rotatable housing 30 to enable access to a weapons cassette 45 securing various weapons 12 stored in an interior compartment 34 as shown in FIG. 4. As will be discussed in more detail later, a key pad 75 is electronically connected to a locking mechanism 80 located in the lower assembly 18 and is adapted to lock and unlock the rotation of the rotatable housing 30.

Figure 2:
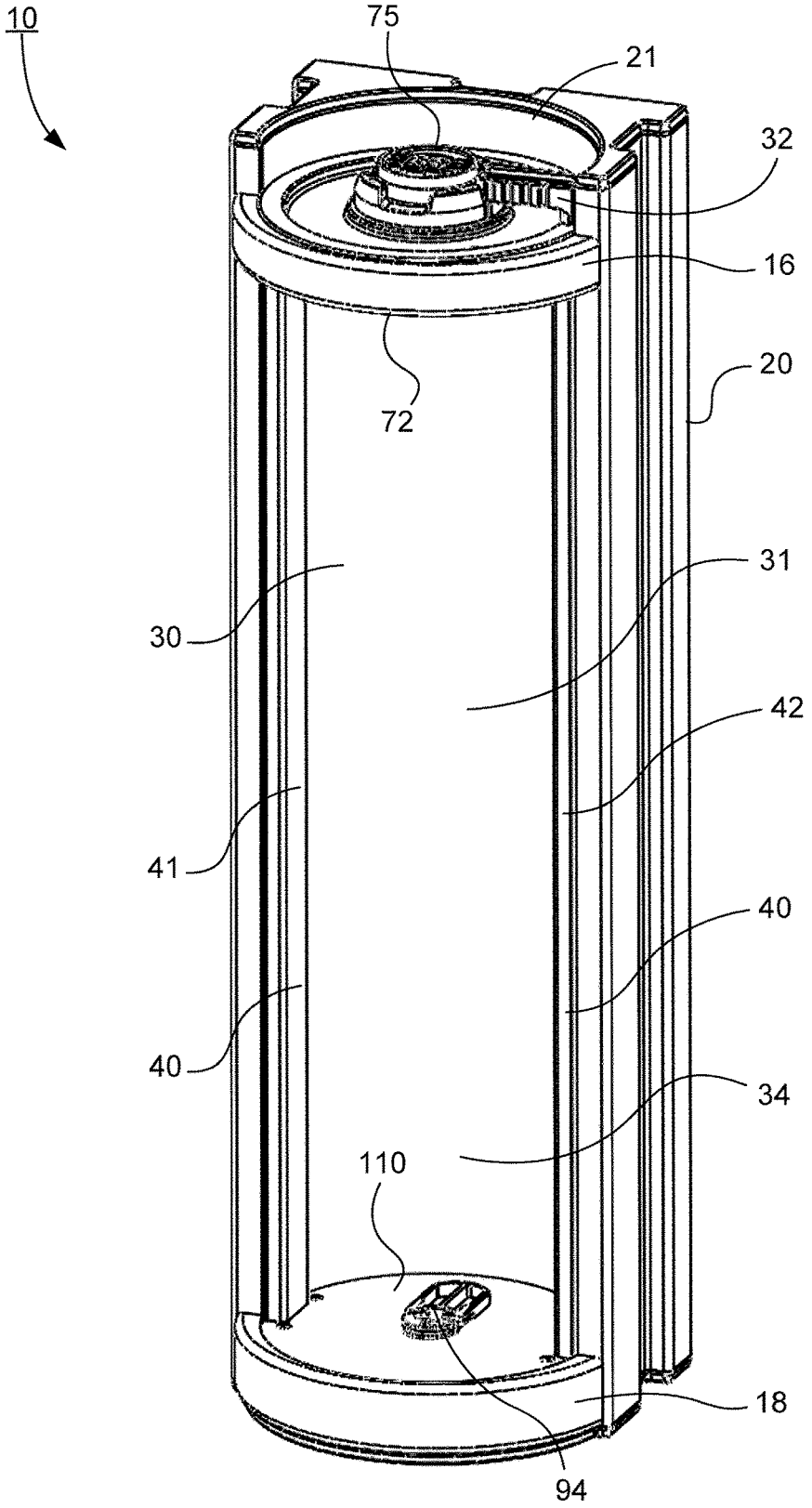
FIG. 2 depicts the weapons storage system in an unlocked position.
Figure 3:
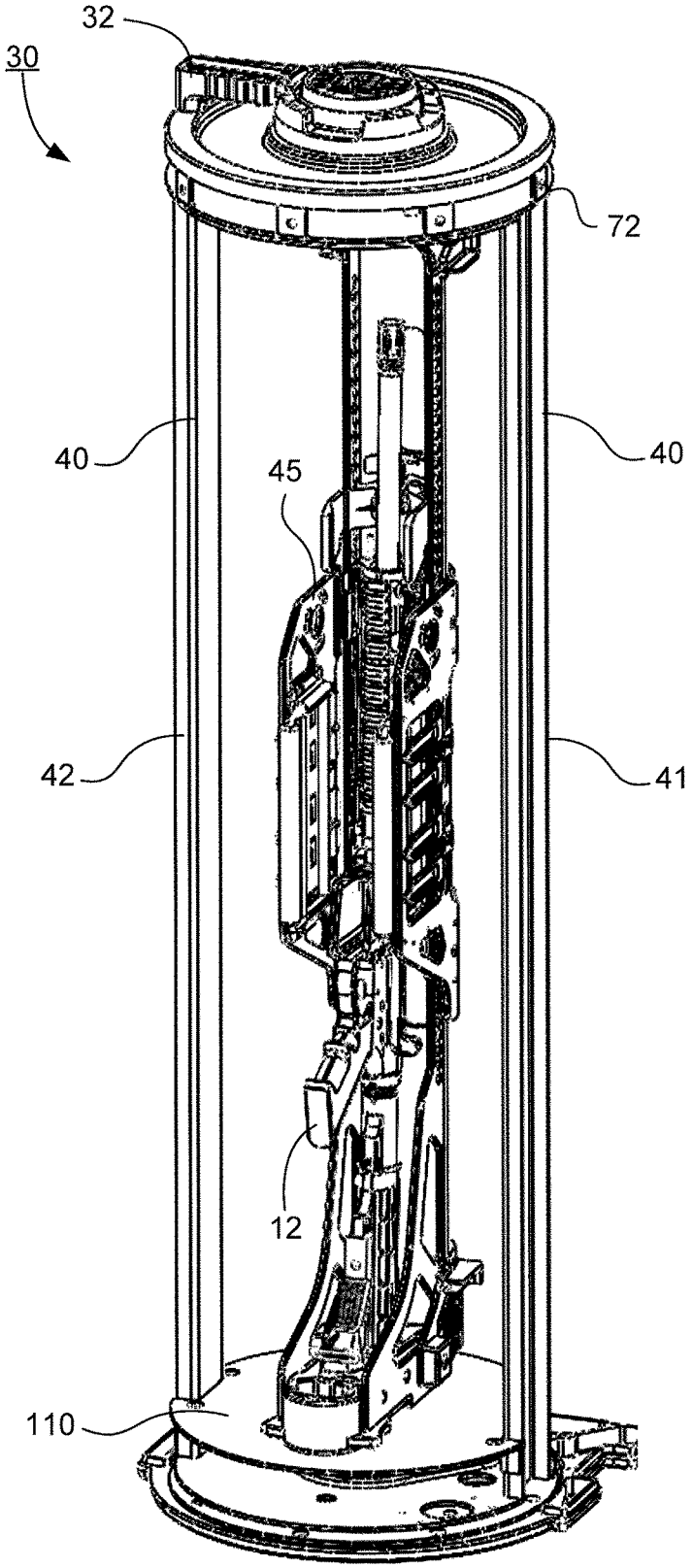
FIG. 3 shows the rotatable housing and weapons cassette having a weapon secured within the weapons cassette.

FIGS. 2 and 3 show the inner secure rotatable housing 30 is constructed in a tubular vertical shape and includes a pair of vertical frame members 40 having a first vertical frame member 41, and a second vertical frame member 42 opposite the first vertical frame member 41. The first vertical frame member 41 and second vertical frame member 42 are attached between the upper door plate 72 and the lower floor plate 110, all of which rotate together as an integrated unit being a part of the rotatable housing 30. The weapons cassette 45 securing the weapons 12 is fixed and the rotatable housing 30 rotates around the weapons cassette 45. It is to be understood that the weapons cassette 45 securing the weapons 12 can also be constructed to rotate with the rotatable housing 30.

In FIG. 2, the inner secure rotatable housing 30 has been rotated approximately 180 degrees from the first locked or closed position shown in FIG. 1. The rotating door 31 of the rotatable housing 30 has been rotated and lies adjacent to the inner curved surface 21 of the rectangular outer base housing 20. The inner curved surface 21 may take a variety of different shapes, such as for example a u-shaped curve, a cylindrical curve or some other curve with a predetermined radius of curvature. The inner curved surface 21 is provided to rotationally mate concentrically with the rotatable housing 30 adjacent to the inner curved surface 21.

The interior compartment 34 within the rotatable housing 30 is constructed as an elongated cylindrical housing. The door 31 is integrated with the rotatable housing 30 and is attached between the vertical frame members 40 and the upper door plate 72 and the lower floor plate 110, and rotates between a first locked closed position (FIG. 1) and a second open unlocked position (FIG. 2).

In FIG. 3, although one weapons cassette 45 is shown provided, it is to be understood that the overall size of the weapon storage system 10 may be sufficiently large enough to house more than one weapons cassette 45. That is, a diameter of the internal compartment 34 of the weapon storage system 10 may be large enough to house two, three or sufficiently more weapons cassettes 45 within the weapon storage system 10.

FIG. 4 shows the rotatable housing 30 rotated approximately midway between the first closed position as shown in FIG. 1 and the second open position as shown in FIG. 2. In the second open position (such as shown in FIG. 2), the door 31 is concentrically rotated into an open position allowing a wide access opening into the interior compartment 34. The door 31 is positioned at the rear of the interior compartment 34 adjacent to the inner curved surface 21 of the outer base housing 20. In the closed position (such as shown in FIG. 1), the door 31 is concentrically rotated into a secure closed position at the front of the interior compartment 34 closing off access to the storage of weapons 12 within the interior compartment 34.

Figure 5:
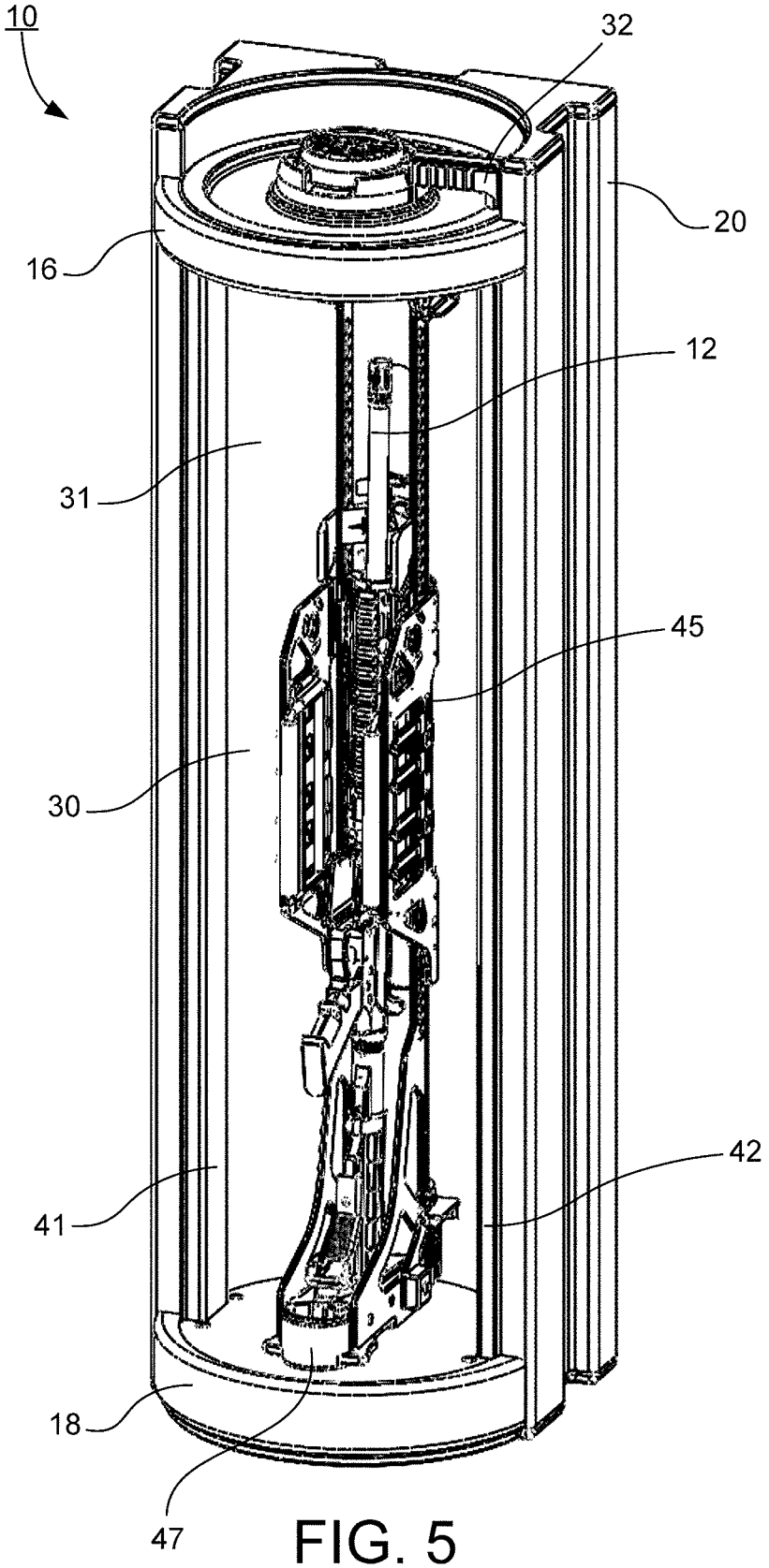
FIG. 5 depicts the weapons storage system in an unlocked open position.
Figure 6:
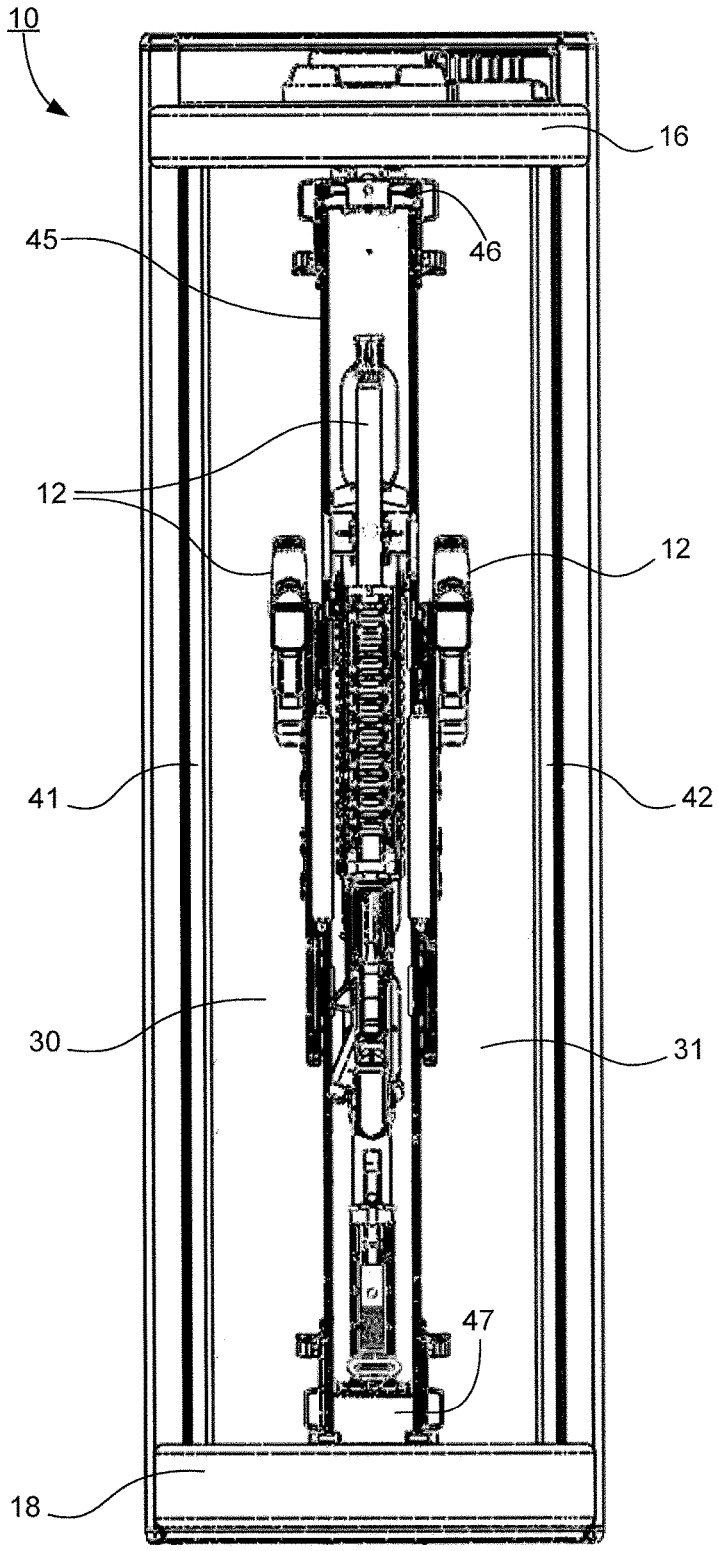
FIG. 6 shows a front view of the weapons storage system in an unlocked open position having various weapons secured to the weapons cassette.

FIG. 4-6 shows the weapons cassette 45 securely mounted within the interior compartment 34 of the weapons storage system 10. As shown, the interior compartment 34 houses the weapons cassette 45. The weapons cassette 45 is also adapted to store and secure various weapons such as a rifle, a hand gun, a high voltage weapon, a baton, magazines, a knife, flashlight, tear gas, handcuffs, vest, pepper spray, ammunition and other weapons and equipment suitable for law enforcement use.

Figure 7:
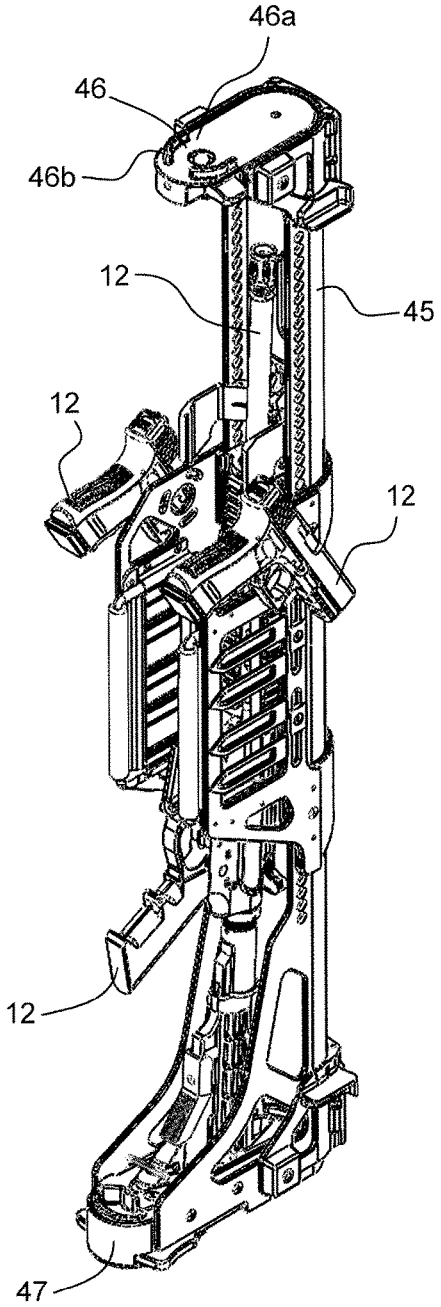
FIG. 7 illustrates the weapons cassette removed from the weapons storage system.

FIG. 7 illustrates the quick disconnect construction of the weapons cassette 45 removed from within the rotatable housing 30. An advantage of this weapons storage system 10 is the ability of the entire weapons cassette 45 to be quickly and easily released from its storage position inside of the interior compartment 34 of the weapons storage system 10. As will be described in more detail later, a locking mechanism 80 disposed in the lower assembly 18 is provided to prevent the rotatable housing 30 and the rotatable door 31 to permit access to the weapons 12 from being rotated into an open position to maintain the security of the weapons cassette 45 within the weapons storage system 10.

Figure 8:
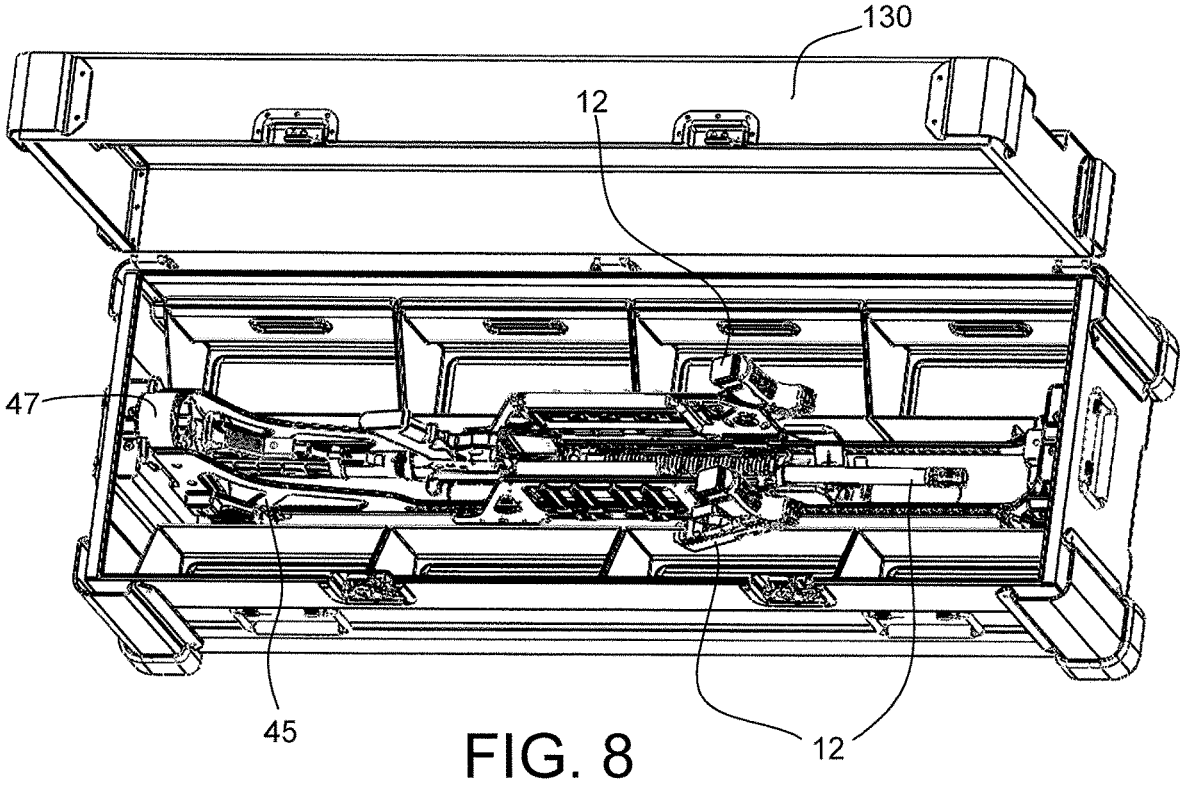
FIGS. 8-9 depict the weapons cassette placed into a transfer carrying case.
Figure 9:
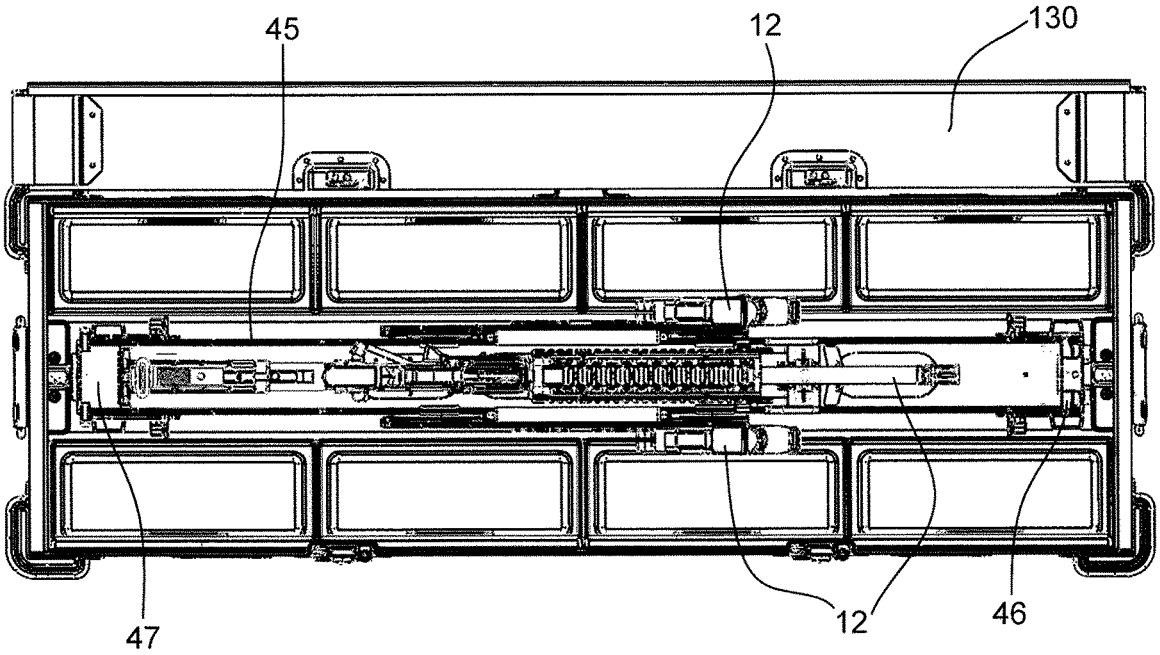

FIGS. 8-9 show a transfer carrier case 130 into which the weapons cassette 45 may be placed and transferred to another location in a concealed manner. The transfer carrier case 130 may take a variety of different sizes and/or shapes. In this exemplary embodiment, the transfer carrier case 130 is configured like a suitcase as a rectangular compartment carrying case with a pivoting lid. The transfer carrier case 130 may be adapted to securely receive the weapons cassette 45 within the transfer carrier case 130 and transport the weapons cassette 45 from the weapons storage system 10 to a remote location. The transfer carrier case 130 may also include a mounting assembly adapted to receive the upper weapons cassette mount 46 and the lower weapons cassette mount 47 to secure the weapons cassette 45 within the transfer carrier case 130.

For example, a weapons storage system 10 may be securely located in a police station. A police vehicle may be provided with a mating mounting system adapted to receive the entire weapons cassette 45. As such, an authorized user (such as a police officer) may remove the weapons cassette 45 containing the various weapons 12 (rifle, handgun, stun gun, etc) and ammunition from its secure location in the weapons storage system 10 and transport it from within the police station to the police vehicle in the transfer carrier case 130.

Alternatively, the police vehicle may be adapted to receive and lock the entire carrier case 130 with the weapons cassette 45 disposed therein into the vehicle at a predetermined location, such as in the trunk of the vehicle. The trunk of the vehicle may be equipped with a mating mounting system adapted to receive the entire carrier case 130.

In another use example, once the user arrives at the police vehicle, she may easily remove the weapons cassette 45 from the transfer carrier case 130 and securely install it to a mating mounting system adapted to engage the upper weapons cassette mount 46 and the lower weapons cassette mount 47 within the police vehicle. The advantage of the self-contained weapons cassette 45 is that the police officer does not have to independently retrieve numerous weapons and ammunition and various pieces of equipment required for their job and carry them separately from the station to the police vehicle. This process can be cumbersome and time consuming. The weapons cassette 45 acts as a self-contained unit capable of carrying all of the various pieces of equipment all together attached to the weapons cassette 45 as a single secure unit.

Figure 10:
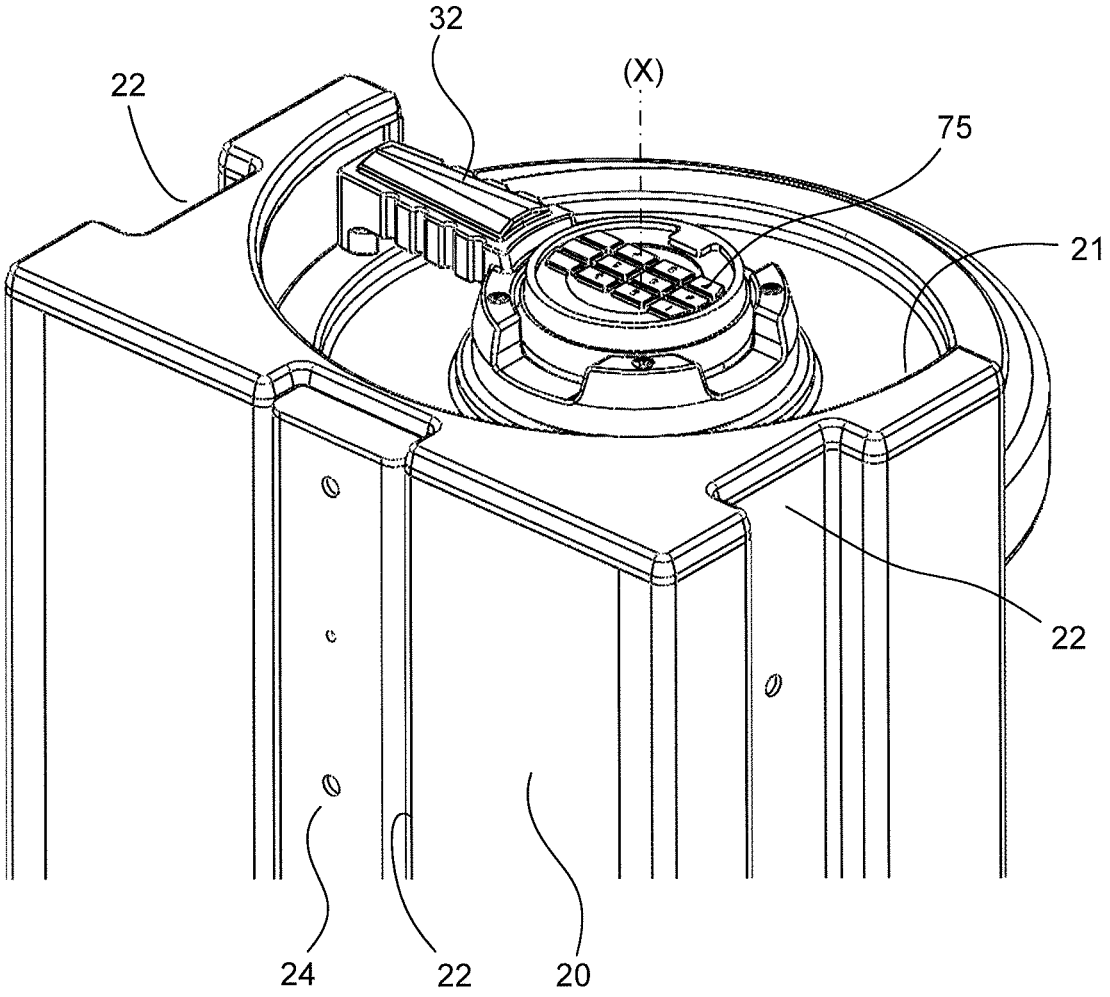
FIG. 10 shows an upper rear perspective view of the weapons storage system and mounting system.

In FIG. 10, returning to the construction of the weapons storage system 10, a rear view of the rectangular outer base housing 20 is shown. Various mounting channels 22 can be provided about the various surfaces of the outer base housing 20 for securing the weapons safe 10 to another surface, such as a wall. A mounting bracket such as a mating elongated rigid bar 24 can be securely anchored to the wall or other surface by various threaded secure fasteners. The channel 22 can be constructed and aligned with the elongated rigid bar 24 for securing to the wall or surface. The weapons safe storage system 10 can be mounted to the surface upon which it is resting, such as a floor and/or any other suitable surface.

As shown from this angle, the handle 32 is secured to a center axis (X) that it rotates around and extends radially outward therefrom. The rectangular outer base housing 20 includes the curved interior surface 21 adapted to receive the secure the rotatable housing 30. The handle 32 rotates around the center axis (X) and has enough space provided between an end of the handle 32 and the inner curved interior surface 21 for rotation between the first closed position and the second open position.

Figure 11:
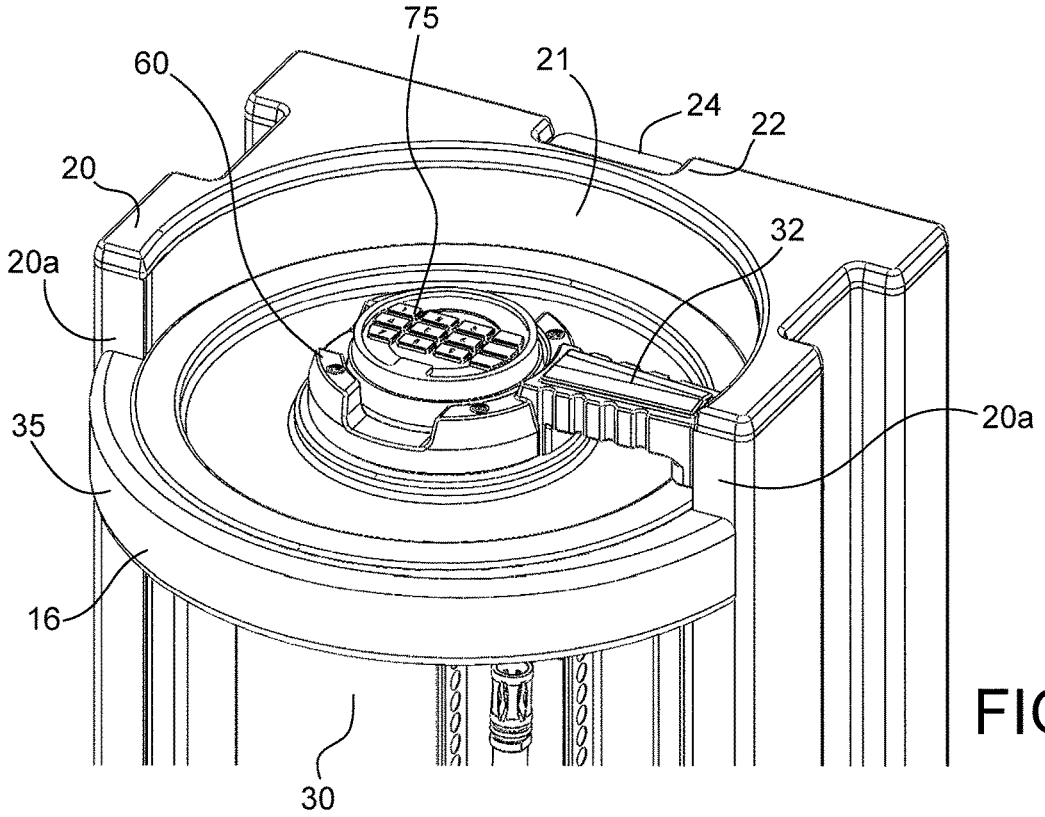
FIG. 11 illustrates an upper front perspective view of the weapons storage system.
Figure 12:
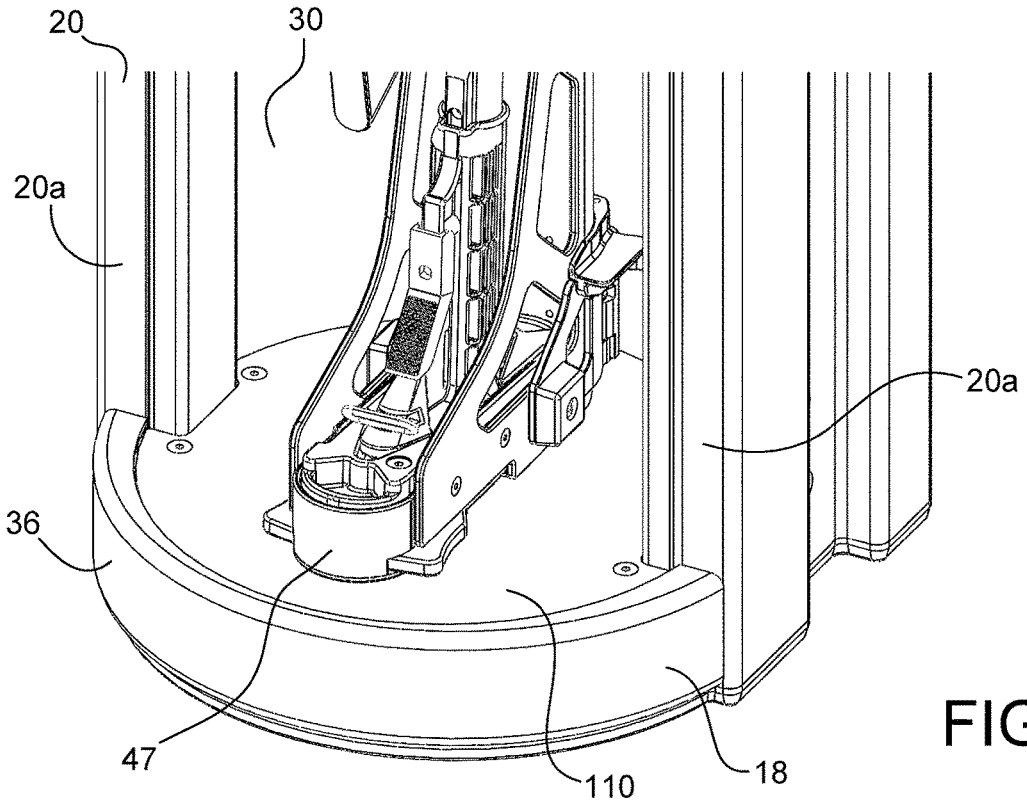
FIG. 12 depicts a lower perspective view of the weapons storage system in an unlocked open position.

FIGS. 11-12 depict upper perspective views of the top assembly 16 and the lower assembly 18 in the weapons storage system 10. FIG. 11 shows an upper circular cap 35 provided at the top assembly 16 upper end of the secure rotatable housing 30. A lower circular cap 36 is shown in FIG. 12 and is provided at the lower assembly 18 lower end of the secure rotatable housing 30.

The upper circular cap 35 may be semicircular in shape and may be attached to a front face 20*a* of the base housing 20. Alternatively, the upper circular cap 35 may be circular and may be recessed and securely attached within a semicircular channel (not shown) provided in the front face 20*a* and inner curved surface 21 of the upper end of the base housing 20. The upper circular cap 35 covers and prevents access to the interior compartment within the top assembly 16 that houses the handle assembly 60. Various constructions for the upper circular cap 35 are possible.

Likewise, the lower circular cap 36 may be semicircular in shape and may attach to the front face 20*a* of the base housing 20. Alternatively, the lower circular cap 36 may be circular and may be recessed and securely attached within a semicircular channel (not shown) provided in the front face 20*a* and inner curved surface 21 at the lower end of the base housing 20. The lower circular cap 36 covers and prevents access to the interior compartment within the lower assembly 18 that houses the lower locking mechanism 80. Various constructions for the lower circular cap 36 are possible.

Figure 13:
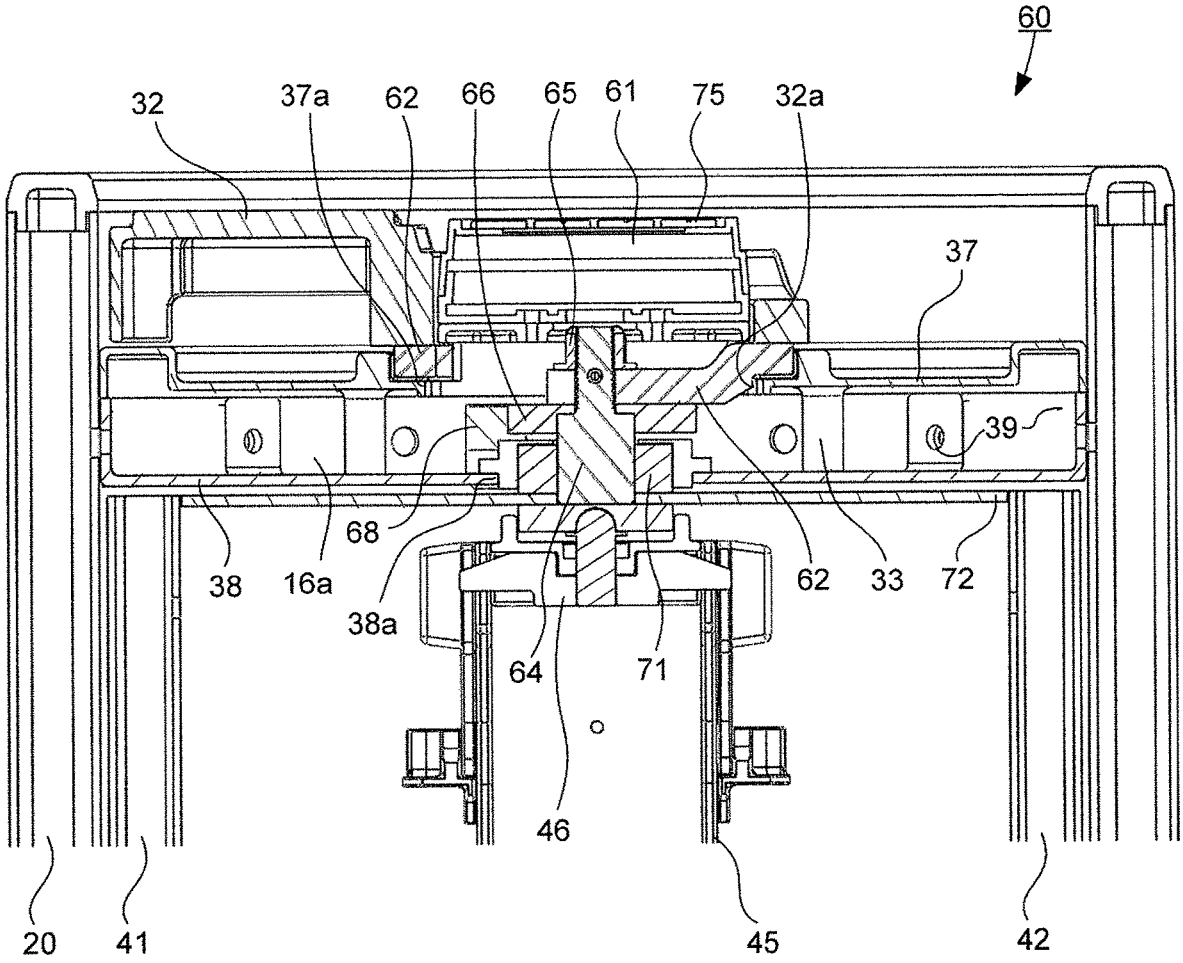
FIG. 13 shows a cross section view of the top assembly and the handle assembly.
Figure 14:
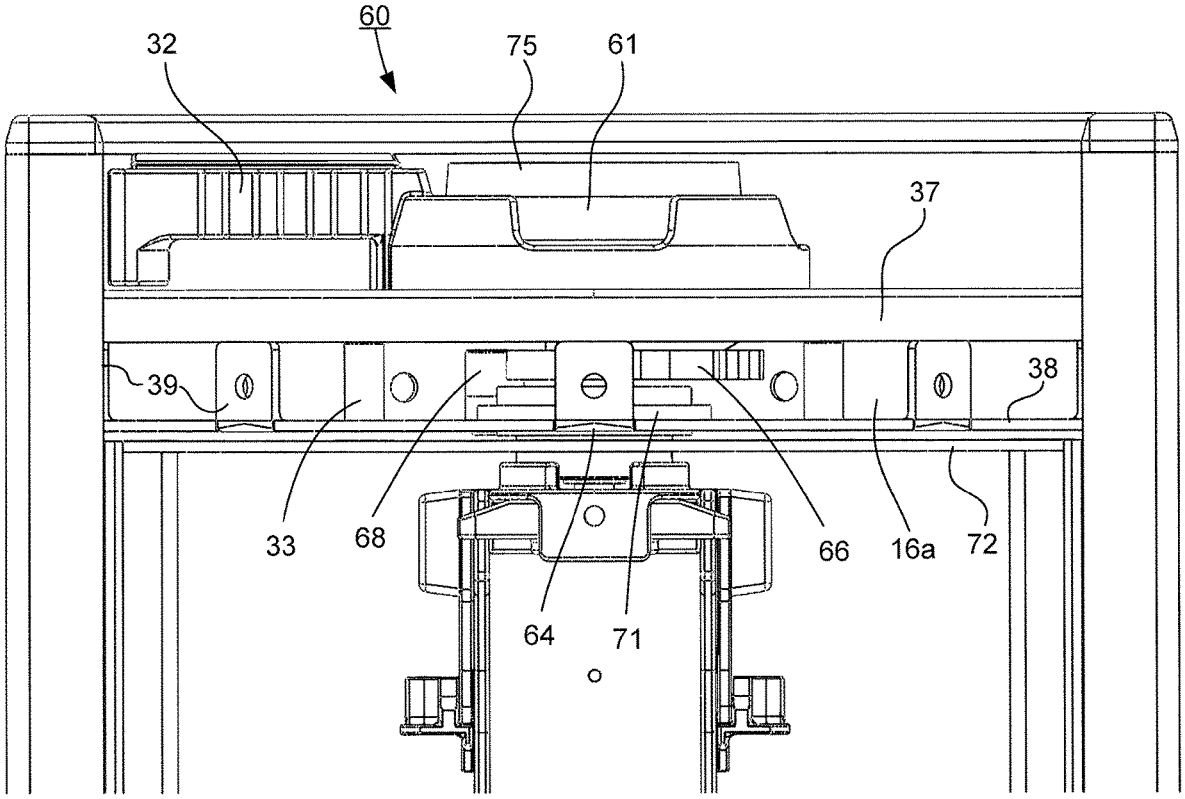
FIG. 14 depicts a side view of the top assembly and the handle assembly.
Figure 15:
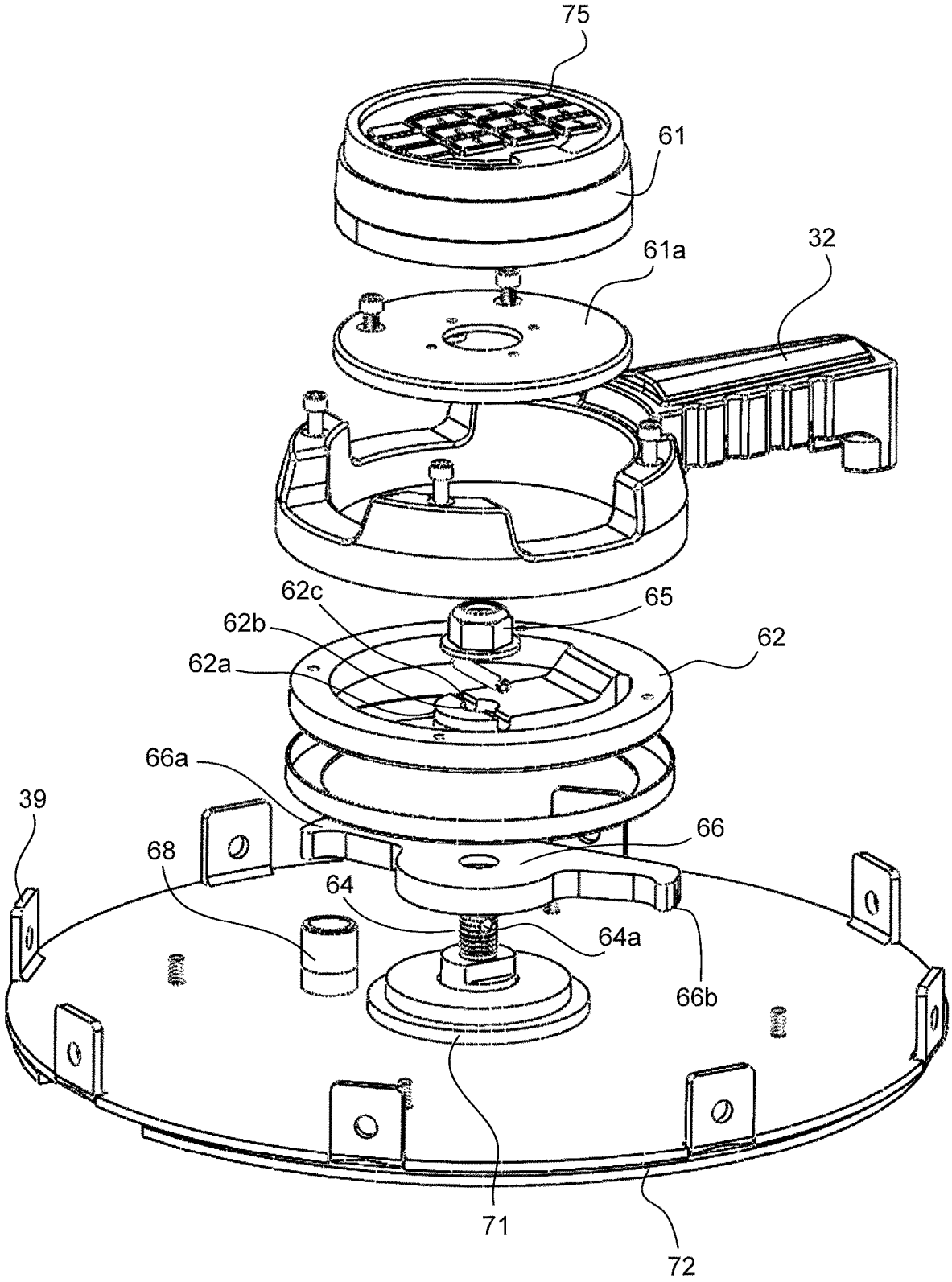
FIG. 15 illustrates an exploded perspective view of the top assembly and the handle assembly.

FIGS. 13-15 show a cross section, a side view and exploded view of the handle assembly 60. The top assembly 16 is located above the interior compartment 34 of the weapon storage system 10. The top assembly 16 includes an interior space 16*a* defined between an upper inner circular cap 37 and an upper inner base cap 38. The upper inner circular cap 37 may be attached to the upper inner base cap 38 in a variety of different ways. Various fastener projections 33 may extend from the upper inner circular cap 37 adapted to receive various fasteners to secure the upper inner base cap 38 to the upper inner circular cap 37. The upper inner circular cap 37 and the upper inner base cap 38 are fixed to the rectangular outer base housing 20.

The upper inner base cap 38 may be secured to the upper outer circular cap 35 and/or the rectangular outer base housing 20 in a variety of different ways. For example, and as shown, various tabs 39 may extend from the upper inner base cap 38 having a fastener hole adapted to receive a fastener to secure the upper inner base cap 38 to the upper outer circular cap 35 and/or the rectangular outer base housing 20.

The weapons storage system 10 includes an upper inner circular cap 37 and the upper inner base cap 38. An upper surface of the upper inner circular cap 37 may be constructed to include an upper aperture 37*a* in the center having a shoulder and a concentric channel encircling the shoulder surrounding the upper aperture. Likewise, the upper inner base cap 38 may also have a lower aperture 38*a* substantially aligned with and below the upper aperture 37*a* in the upper inner circular cap 37. The upper aperture 37*a* and the lower aperture 38*a* adapted to receive the various components of the handle assembly 60.

In construction, the handle 32 has a central opening 32*a* adapted to receive a handle cap 61 therein. The central opening of the handle 32 is positioned above the upper aperture 37*a* in the upper inner circular cap 37 and allowed to rotate around the upper aperture 37*a*. The handle 32 is attached to a support ring 62 with an internal tongue 62*a* having an aperture 62*b* and a recessed groove 62*c* bisecting the aperture 62*b*.

The support ring 62 is fastened to an upper main shaft 64 having an extending cross member 64*a* that mates with the recessed groove 62*c* in the internal tongue 62*a* of the support ring 62. An upper stop plate 66 is located on the upper main shaft 64 below the internal tongue 62*a* of the support ring 62. The upper stop plate 66 rotates a predetermined rotational distance between a first position and a second position defined by a position of an upper stop shaft 68. As shown, the upper stop plate 66 has a central substantially circular base with a pair of arms 66*a*, 66*b* that extend therefrom.

Figure 16:
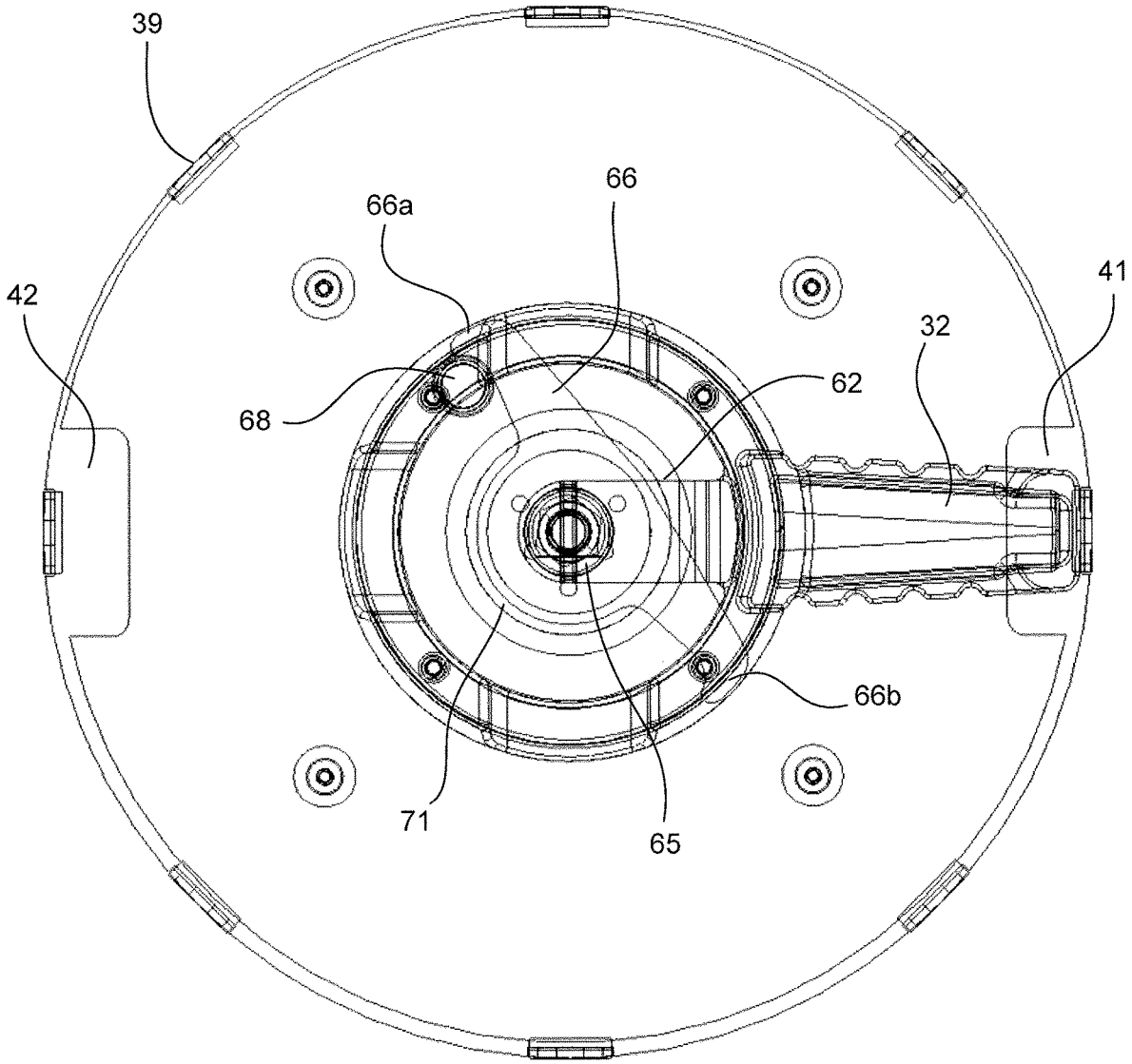
FIG. 16 depicts a top view of the top assembly and the handle assembly.

FIGS. 15-16 illustrates the first position (such as in a closed position), in which a first arm 66*a* engages the upper stop shaft 68 at a first orientation. In a second position (such as in an open position), a second arm 66*b* engages the upper stop shaft 68 at a second orientation. The upper stop shaft 68 defines the boundaries between which the handle assembly may rotate. One example may be a 180 degree turn between a first and a second position to define an open and a closed position. However, it is to be understood that the rotation degree can be varied according to this subject disclosure.

An upper bushing 71 is located on the upper main shaft 64 just below the upper stop plate 66. The upper bushing 71 is positioned between the upper main shaft 64 and an upper door plate 72 so that the handle assembly 60 may rotate the upper door plate 72 through the fixed top portion defined by the upper inner circular cap 37 and the upper inner base cap 38 that is fixed to the upper outer circular cap 35 and/or the rectangular outer base housing 20. The keypad 75 is disposed within a central portion of the handle 32. Circuitry for the keypad 75 may be embodied in an interior space between the handle cap 61 and a lower handle cap base cover 61*a*. As shown and described later, a conductor may extend from the circuitry of the keypad 75 to the lower locking mechanism 80. The various components are rotationally fixed between the handle 32 and the upper door plate 72 by a nut fastener 65 threadedly attached to an upper end of the upper main shaft 64.

Figure 17:
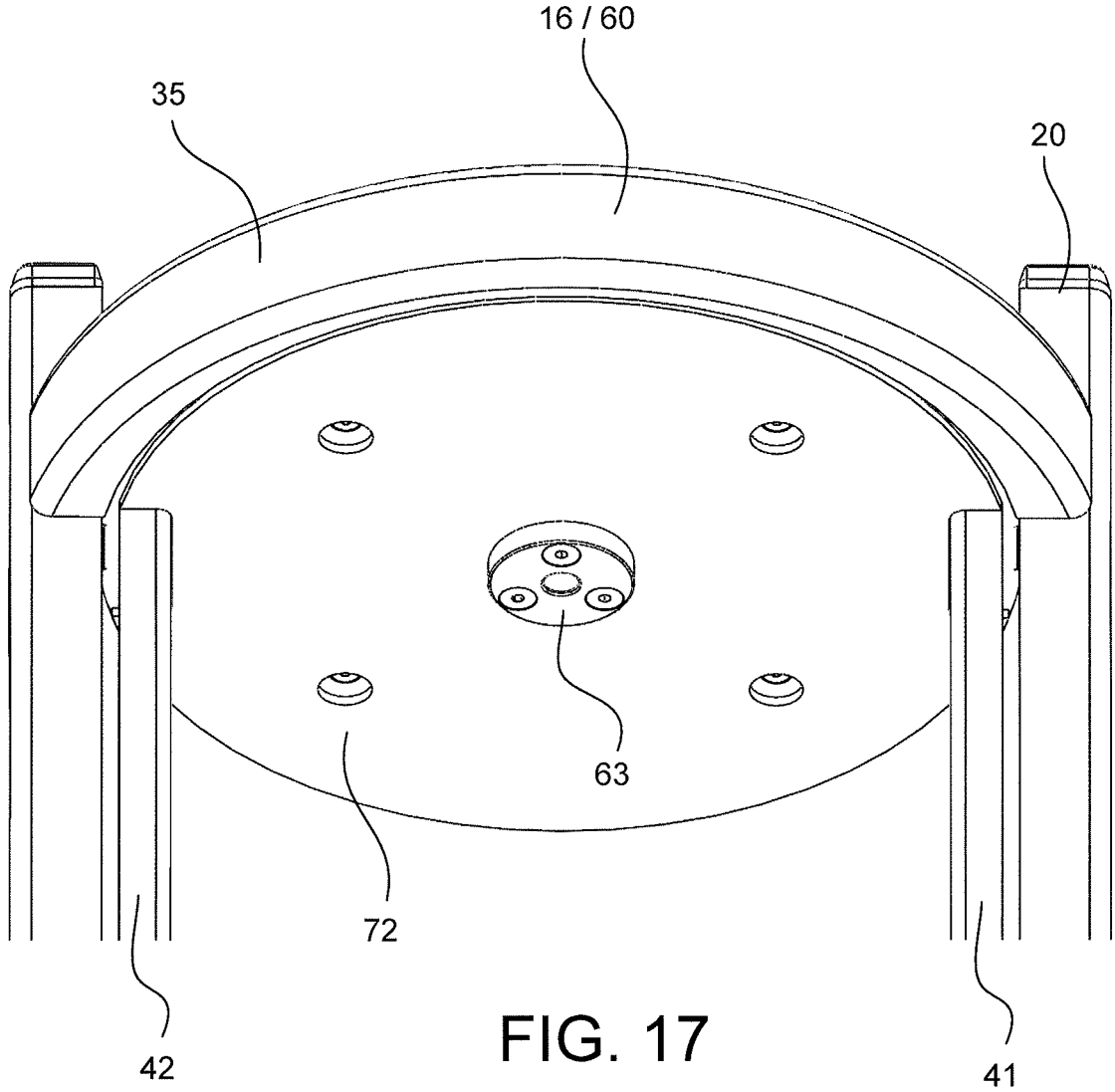
FIG. 17 shows a lower perspective view of the top assembly of the weapons storage system.
Figure 18:
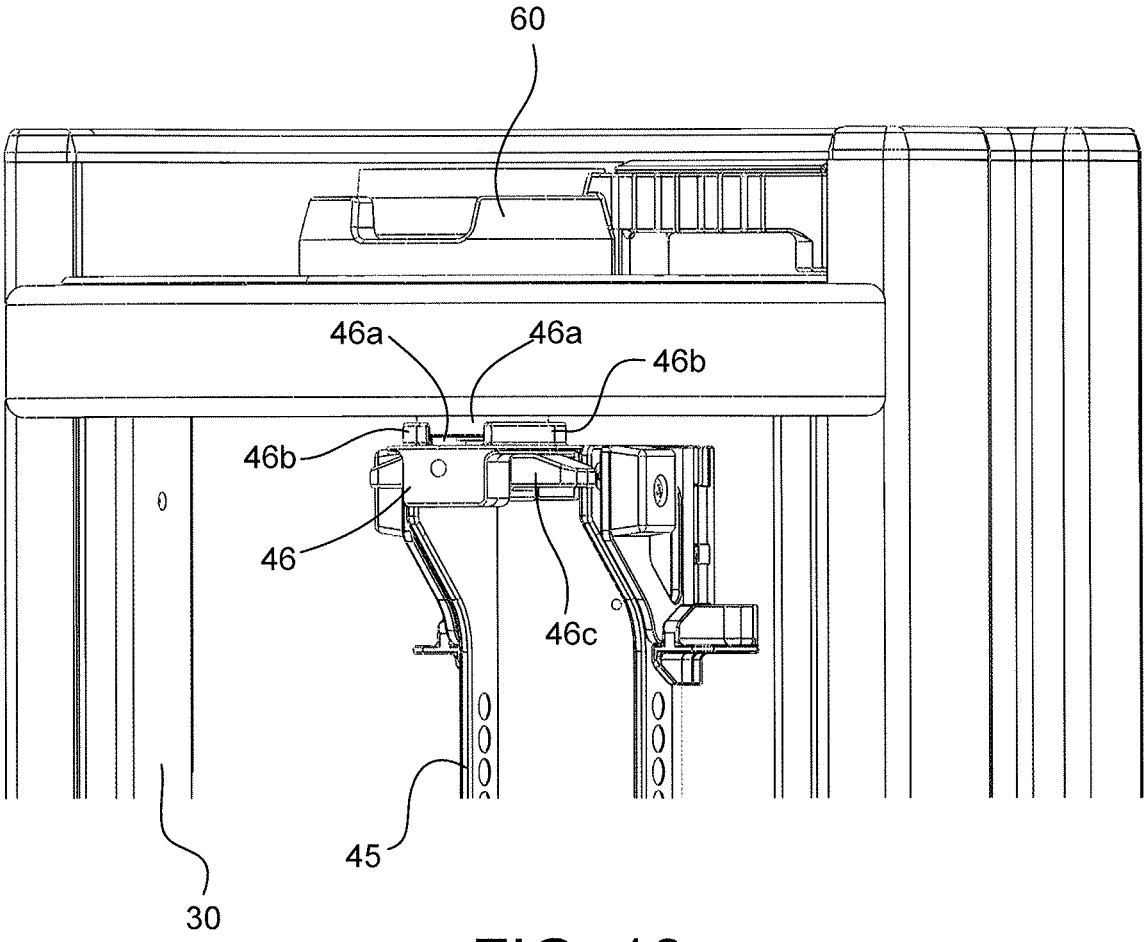
FIG. 18 depicts a side view of the top assembly, the handle assembly and the weapons cassette attached thereto.

FIG. 17 shows the top assembly 16 including an upper locking mount 63 provided just below the upper door plate 72 adapted to be connected to the upper weapons cassette mount 46. FIG. 18 shows a side view of the handle assembly 60 connected through the upper locking mount 63 to the upper weapons cassette mount 46 attached to the weapons cassette 45. In operation, the weapons cassette 45 may be fixed and may not rotate as the handle assembly 60 and the rotatable housing 30 rotate together between an open position and a closed position. Alternatively, the weapons cassette 45 may be adapted to rotate with the rotation of the handle assembly 60 and the rotatable housing 30 as they rotate together between an open position and a closed position.

The upper weapons cassette mount 46 is positioned at the upper end of the weapons cassette 45 and is adapted to engage and lock onto the upper locking mount 63 attached to the top assembly 16 and the handle assembly 60.

FIG. 18 shows the upper weapons cassette mount 46 of the weapons cassette 45 having a receiving cup portion 46*a* (as shown in FIG. 7) with an outer guide 46*b* portion adapted to receive and align the upper locking mount 63 within the outer guides 46*b*. A pair of release levers 46*c* are integrated into the upper weapons cassette mount 46 and function as latch release levers to release the upper locking mount 46 from the upper locking mount 63 in a quick manner when the release levers 46*c* are depressed.

Figure 19:
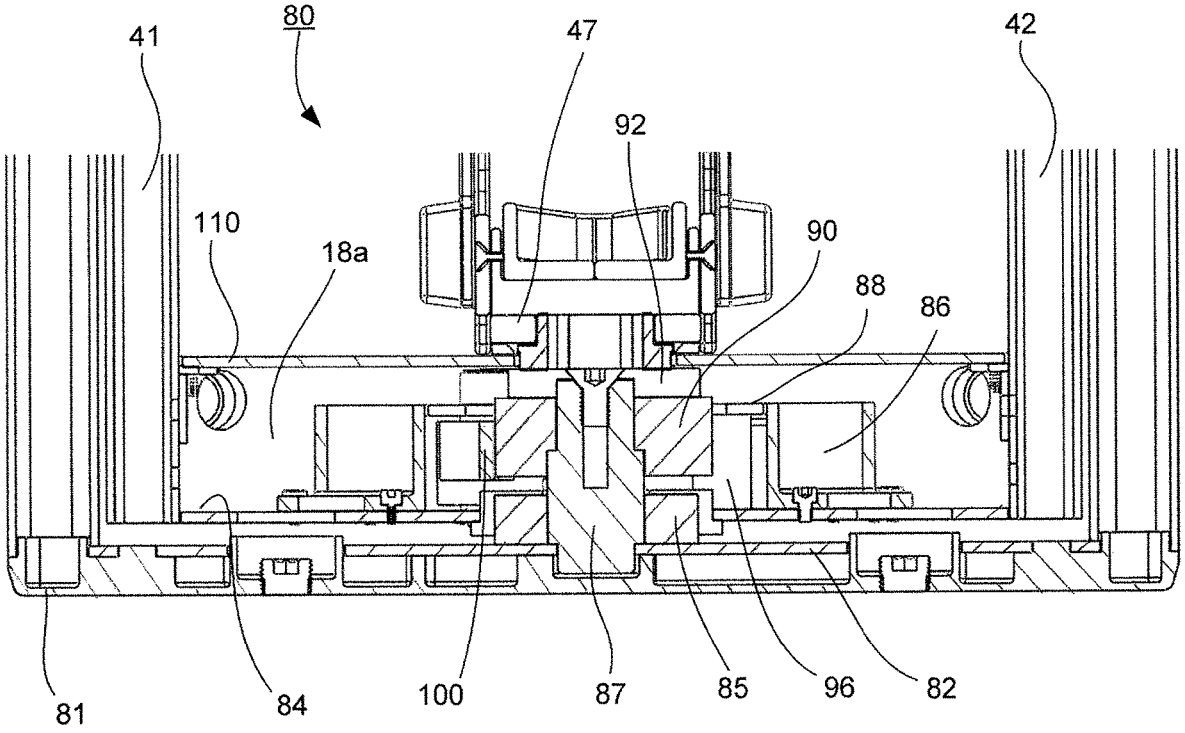
FIG. 19 illustrates a cross section view of the lower assembly and lower locking mechanism therein.

FIG. 19 shows a cross section view of the lower locking mechanism 80 in the lower assembly 18. The lower assembly 18 below the interior compartment 34 of the weapon storage system 10 includes the outer lower circular cap 36 as shown in FIG. 2. The lower assembly 18 includes an interior space 18*a* defined between a lower base plate 81 and a lower floor plate 110. The lower outer circular cap 36 may be attached to the outer base housing 20 in a variety of different ways. Various fasteners may be provided to secure the lower outer circular cap 36 thereto.

Figure 20:
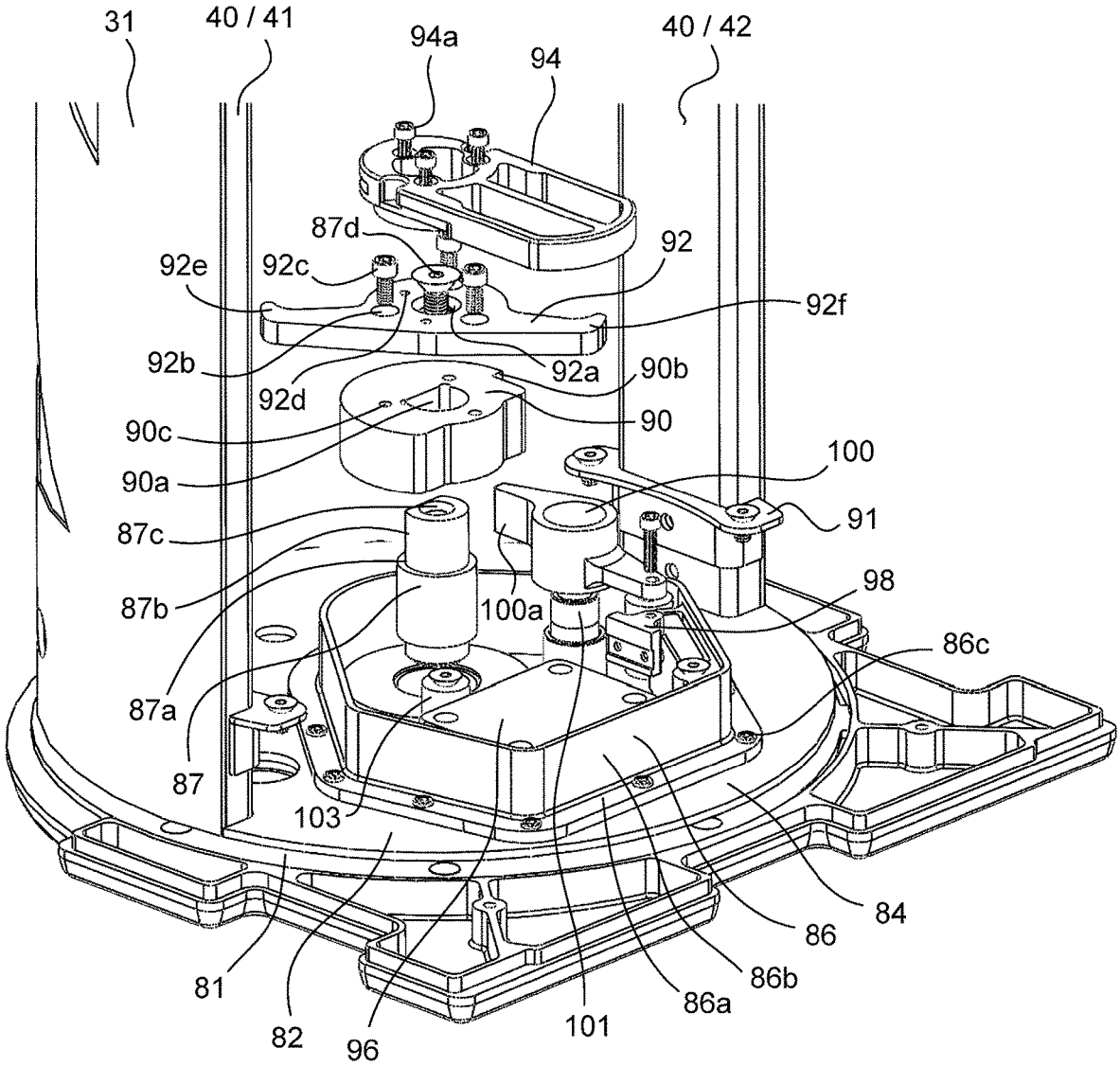
FIG. 20 shows an exploded view of the lower assembly and lower locking mechanism therein.

FIG. 20 shows an exploded perspective view of the lower locking mechanism 80 positioned in a locked position within the vertical frame members 40. The lower assembly 18 is composed of the lower base plate 81 being fixed to the rectangular outer base housing 20. The lower base plate 81 has an outer contour that includes the shape of the rectangular outer base housing 20 and the circular bearing plate 82.

Positioned within the lower assembly 18, the lower locking mechanism is 80 is inaccessible in the middle of the lower end of the weapon storage system 10. This position for the lower locking mechanism 80 is very difficult to obtain access to by a person trying to compromise its security and to gain access to the weapon storage system 10.

However, it is to be understood according to the subject matter of this disclosure, that the locking mechanism can be located in various locations within the construction of the weapon storage system 10. For example, the locking mechanism can also be suitably located in the top assembly 16, in the rectangular outer base housing 20 and/or any other suitable location within the weapon storage system 10.

The bearing plate 82 is fixed to the lower base plate 81. The lower main shaft 87 is disposed in the center of, and attached to the bearing plate 82 and the lower base plate 81. As shown in FIG. 19, a lower bushing 85 is disposed above the bearing plate 82 and concentric to the lower main shaft 87. The lower bushing 85 is connected to the lower door plate 84. The lower bushing 85 is disposed between the bearing plate 82 and the lower door plate 84 and allows the lower door plate 84 to rotate about the lower main shaft 87 without the bearing plate 82 being rotated.

A drill guard 86 is attached to the lower door plate 84 to protect the inner components of the lower locking mechanism 80 from being tampered with by an object such as a screwdriver or other piercing tool, such as a drill, or the like. The drill guard 86 has an L-shape protective cross-sectional view configuration. The lower leg of the L-shape cross section configuration is an outer flange 86*a* that surrounds the upward flange 86*b* portion of the L-shape. The outer flange 86*a* includes various fastener openings 86*c* adapted to receive various fasteners for attachment to the lower door plate 84.

Figure 24:
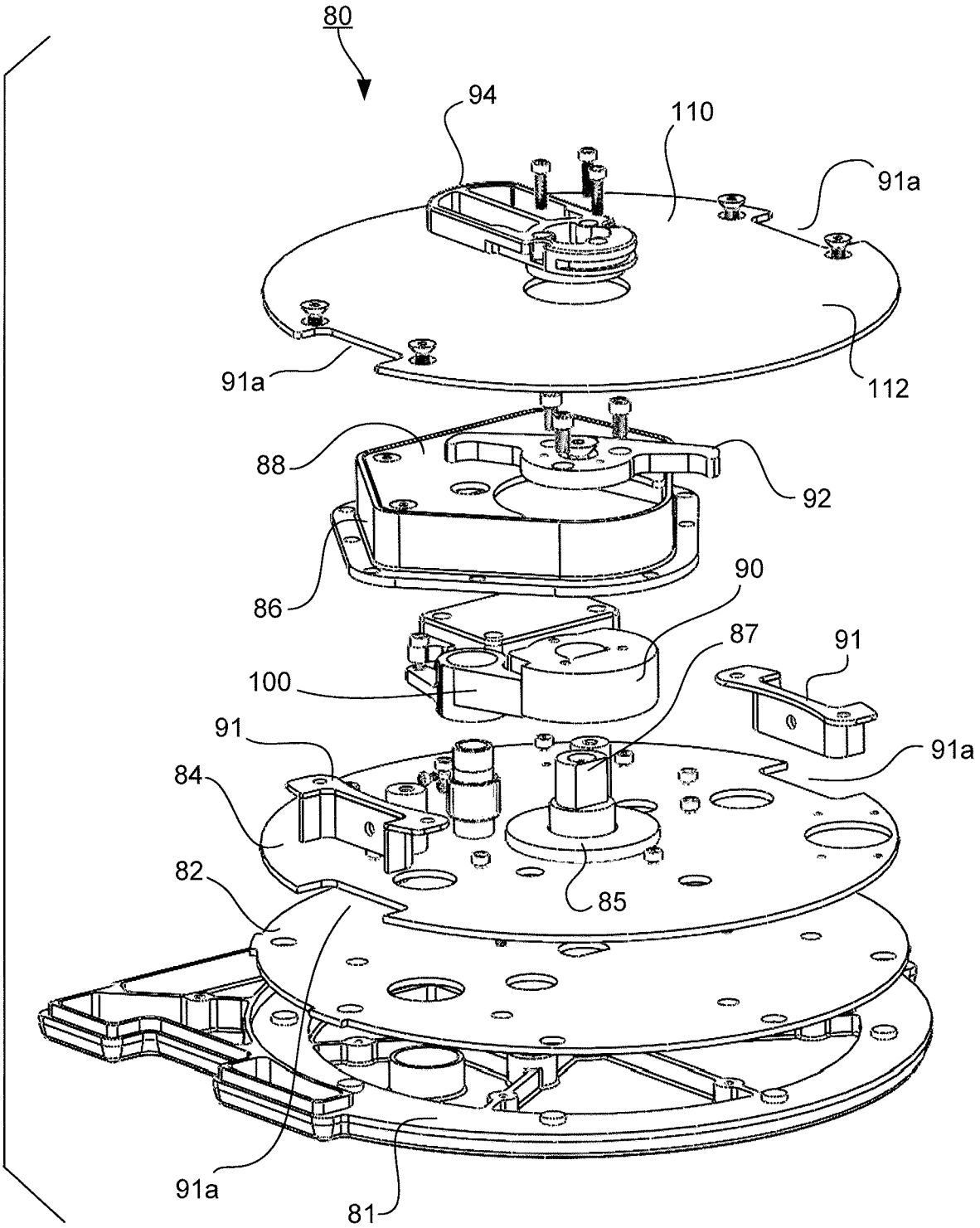
FIG. 24 depicts an upper exploded perspective view of the lower locking mechanism in a locked closed position.

A bridge plate 88 (as shown in FIG. 24) is attached to an upper edge of the upward flange 86*b* portion of the L-shape of the drill guard 86. As shown in FIG. 24, the bridge plate 88 is a cover element that secures tampering of the locking mechanism 80 within the interior space within the drill guard 86 that securely houses the locking mechanism 80.

As shown in FIG. 20, the lower main shaft 87 has a shoulder 87*a* disposed at approximately its central position, and a flat portion 87*b* that is keyed at its upper end above the shoulder 87*a*.

A sear hub 90 is disposed concentrically over the lower main shaft 87 above the lower bushing 85. The sear hub 90 includes a central opening 90*a* having a shape that mates with the keyed flat portion 87*b* of the lower main shaft 87. The mating keyed connection between the lower main shaft 87 and the central opening 90*a* in the sear hub 90 permits the sear hub 90 to be rotationally fixed to the lower main shaft 87. The sear hub 90 is substantially curved and has a notched indentation 90*b* along its perimeter that is adapted to receive a sear lock 100 as will be described later.

A lower stop plate 92 is disposed above the sear hub 90, and is attached through an aperture 92*a* by a shaft fastener 87*d* to another aperture 87*c* in an upper end of the lower main shaft 87. The lower stop plate 92 further includes various apertures 92*b* adapted to receive various other fasteners 92*c* to apertures 90*c* in the sear hub 90.

The lower stop plate 92 has a central substantially circular base with a pair of arms 92*e*, 92*f* that extend from the central substantially circular base. The pair of arms 92*e*, 92*f* intermittently engage a lower sear stop shaft 101 at a first closed position and a second open position respectively.

The lower stop plate 92 is fixed to the lower main shaft 87 and does not rotate as the rotatable housing 30 rotates between a first closed position and a second open position. That is, when the rotatable housing 30 rotates a predetermined rotational distance between an unlocked or first open position and a locked or second closed position, the pair of arms 92*e*, 92*f* are engaged with the lower sear stop shaft 101 respectively.

Figure 23:
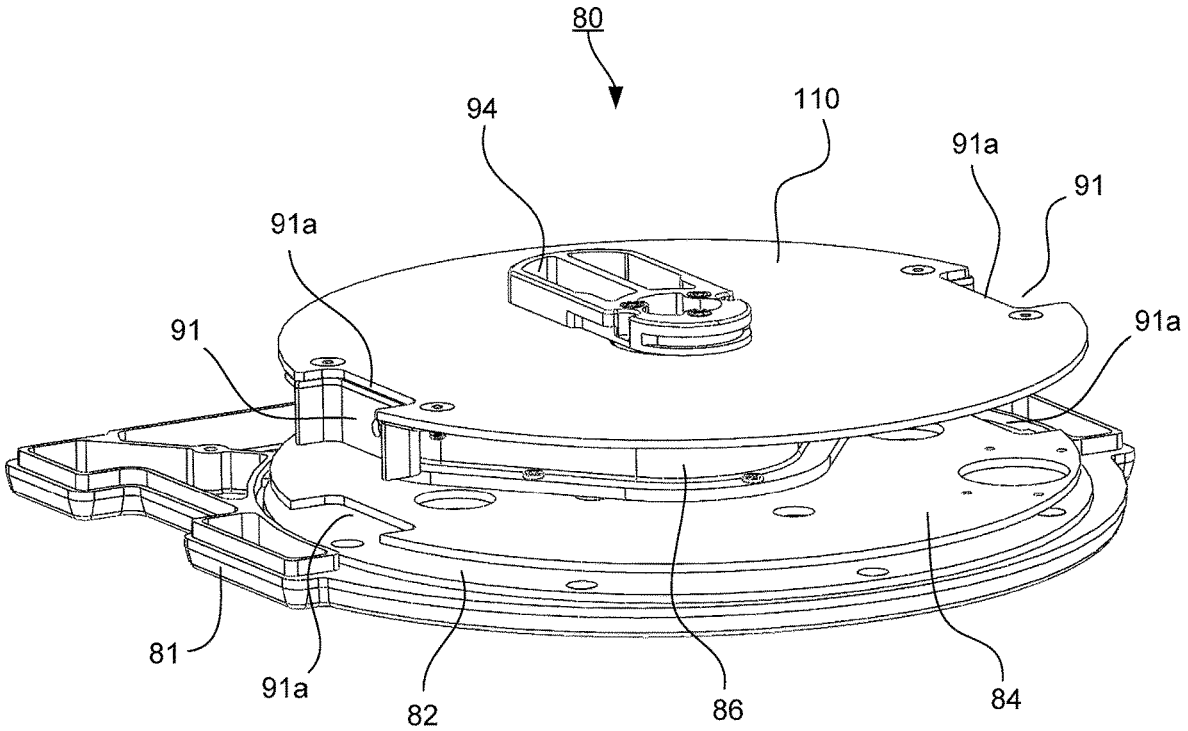
FIG. 23 shows an upper perspective view of the lower locking mechanism in a locked closed position.

A pair of frame member guides 91 are adapted to secure the vertical frame members 40 in position between the lower door plate 84 and the lower floor plate 110. As shown, the frame member guides 91 have a u-shape configuration. The u-shaped frame member guides 91 can be inserted into mating recesses 91*a* (as shown in FIG. 23) disposed in the lower door plate 84 to the lower floor plate 110 and are adapted to secure the lower door plate 84 to the lower floor plate 110 in assembly.

Figure 21:
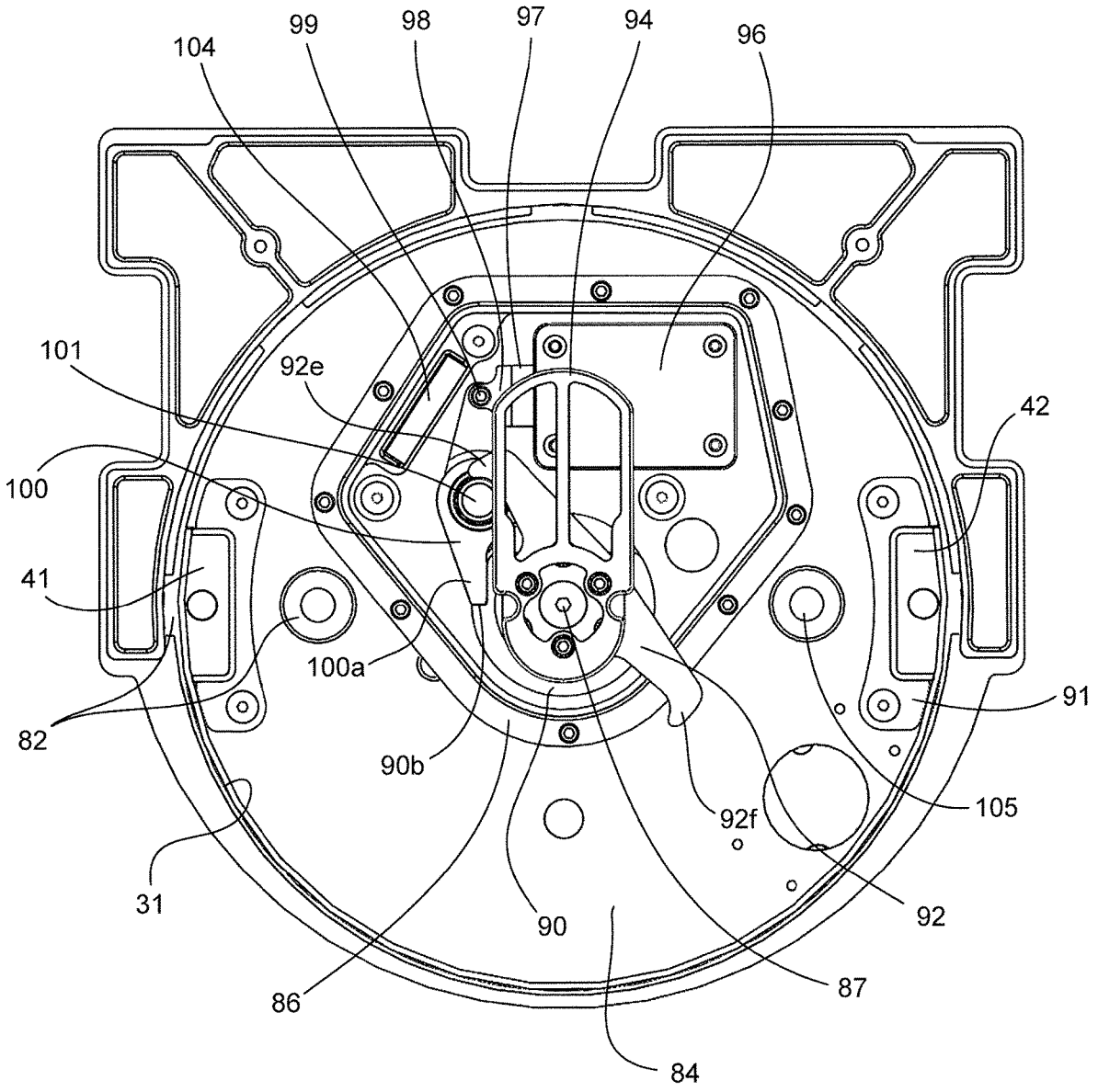
FIG. 21 depicts a top view of the lower locking mechanism in a locked closed position.

FIG. 21 shows a plate 104 disposed in front of the lock nose 97, lock clevis 98, clevis pivot 99 and sear lock 100. The plate 104 is a high strength protective plate which may be made of a variety of different materials, such as a hardened steel plate. The plate 104 is provided to block and protect the various vulnerable parts of the lower lock mechanism 80 form access, such as from a piercing tool, such as a drill trying to obtain access to the lower locking mechanism.

FIG. 21 also shows the lower locking mechanism 80 in a locked or closed position. As shown, the rotatable door 31 is facing forward away from the outer base housing 20, blocking access to the interior compartment 34 of the rotatable housing 30. The rotatable door 31 is secured between, and to the first vertical frame member 41 and the second vertical frame member 42. The rotatable housing 30 has been rotated so that the arm 92*e* engages the lower sear stop shaft 101. To move the rotatable housing 30 into an open position where the rotatable door 31 is rotated open, the lock body 96 must be actuated by the keypad 75 to retract the lock nose 97 and lock clevis 98 in toward the lock body 96 pivoting the projection 100*a* end out of the notched indentation 90*a* in the sear hub 90.

Figure 22:
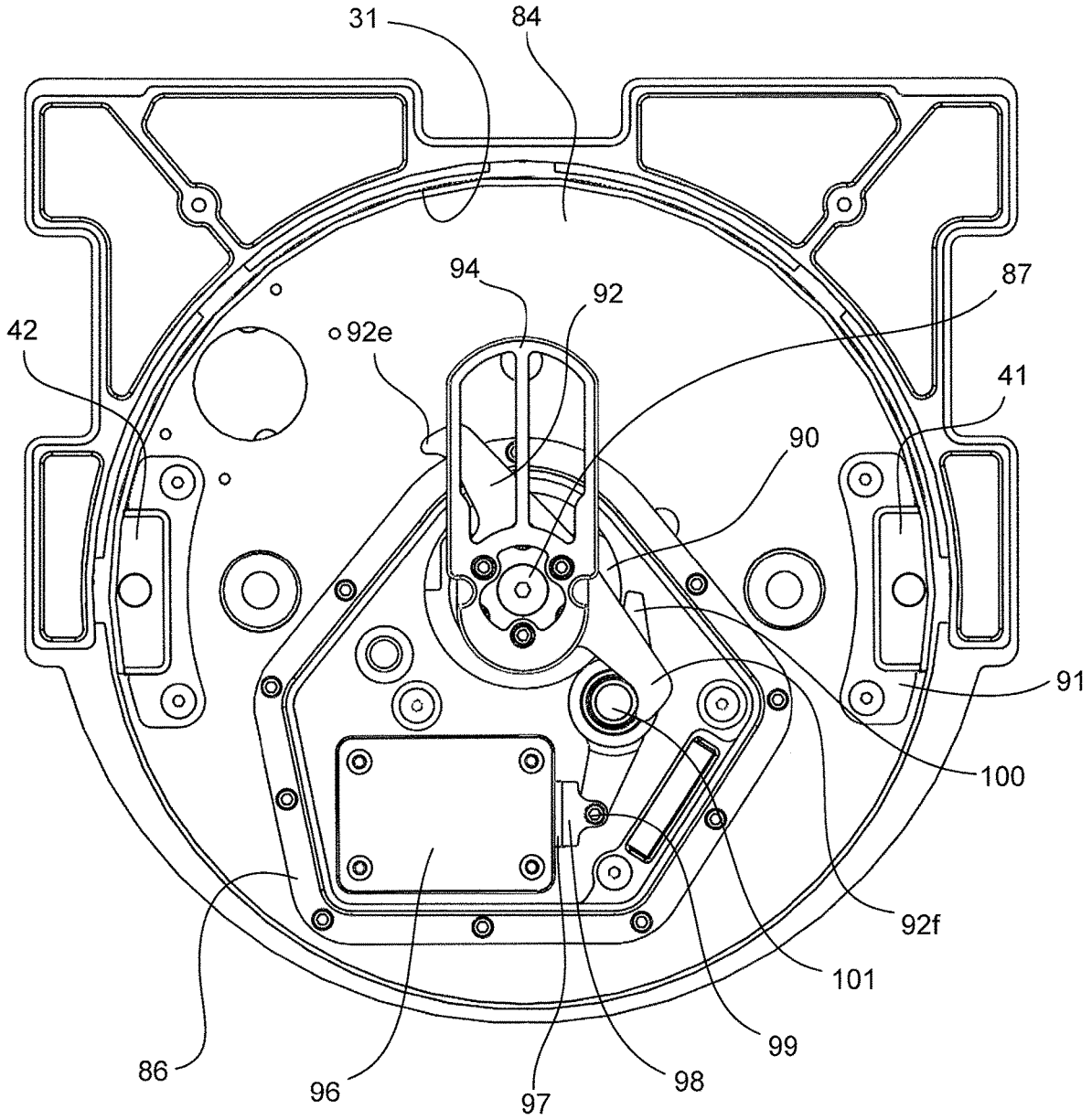
FIG. 22 illustrates a top view of the lower locking mechanism in an unlocked open position.

FIG. 22 shows the lower locking mechanism 80 rotated 180 degrees into an unlocked and open position. As shown, the rotatable door 31 has been rotated 180 degrees and is facing rearward and is positioned against and juxtaposed to the outer base housing 20, unblocking access to the interior compartment 34 of the rotatable housing 30. The first vertical frame member 41 and the second vertical frame member 42 has been rotated 180 degrees and exchanged positions. In this position, the door 31 has been removed from the opening into the interior compartment 34 and access to the interior compartment is provided by a large 180 degree opening defined by the open space disposed between the first vertical frame member 41 and the second vertical frame member 42. In this orientation, the open configuration of the rotatable housing 30 causes the internal compartment 34 and access thereto to thrust out forward from the outer base housing 20 for access into the internal compartment 34. That is, the rotatable housing 30 has been rotated in an opposite direction so that the arm 92*f* engages the lower sear stop shaft 101 at approximately 180 degrees from the closed position shown in FIG. 21.

The lower stop shaft 101 defines the boundaries between which the rotatable housing 30 may rotate. One example may be a 180 degree turn between a first and a second position to define an open and a closed position. In the second open position, the upper stop plate 66 butts up against the upper stop shaft 68, and in the same second open position, the lower stop plate 92 butts up against the lower stop shaft 101 correspond at equal rotational angles. Likewise, in the locked position, the upper stop plate 66 butts up against the upper stop shaft 68 at 180 degrees from the first open position, and in the same unlocked position, the lower stop plate 92 butts up against the lower stop shaft 101 at 180 degrees from the first open position, also correspond at equal rotational angles to close the weapon storage system 10.

As shown in FIGS. 19, 23 and exploded FIG. 24, a lower floor plate 110 is disposed above the lower stop plate 92. The lower floor plate 110 covers the interior compartment 18*a* defined within the lower assembly 18. The lower floor plate 110 may be a single piece construction or a multi-piece construction.

A lower locking mount 94 is then attached above, and to, the lower floor plate 110 and the lower stop plate 92 by the various fasteners 94*a* into various apertures provided in the lower stop plate 92. The lower locking mount 94 engages with the lower weapons cassette mount 47 in a quick disconnect manner and will be described in more detail later.

FIGS. 21-22 illustrate a locking element provided in the lower assembly 18. The locking element is comprised of a lock body 96 having a retractable lock nose 97 with a lock clevis 98 disposed on an end. The lock nose 97 of the lock body 96 is adapted to extend and retract into and out of the lock body 96. The extending and retracting motion may be in response to a mechanical or electronic switching element that actuates the movement of the lock nose 97 inward and outward of the lock body 96. The lock clevis 98 is attached at a pivot 99 to a sear lock 100. The sear lock 100 has a circular central body that is disposed concentric about the lower sear stop 101.

As an electronic switching element, the lock body 96 is an electronic component or device that can switch an electrical circuit, i.e., by interrupting the current or diverting it from one conductor to another in response to actuation by another electronic element. The electronic switching element responds to an external force to mechanically or electrically change an electric signal. Switches are used to turn electric circuits ON and OFF and to switch electric circuits. One such example of the electronic switching element can be for example an electronic keypad 75.

FIGS. 10-11, 15 and 32 show a digital door lock embodied as a keypad 75 integrated into the handle cap 61. The keypad 75 may be embodied as a display interface and/or set of buttons arranged in a block or "pad" which usually bear digits, symbols and usually a complete set of alphabetical letters or numerals. The keypad may require a special code, such as a specific alphabetic, numeric, a specific pattern swipe and/or some input combination thereof to generate and send a signal from the keypad 75 to the lock body 96 to actuate movement of the lock nose 97 into or out of the lock body 96.

At rest, the lock nose 97 disposed within the lock body 96 may be biased in the locked position in which the projection 100*a* of the sear lock 100 is biased into the notched indentation 90*a* of the sear hub 90*a* shown in FIG. 21. The lock nose 97 may be spring loaded to bias the projection 100*a* into the notched indentation 90*b* of the sear hub 90. When the lock body 96 is actuated to an unlocked position by a correct code being received at the keypad 75, the projection 100*a* of the sear lock 100 is actuated to move away from the notched indentation 90*b* of the sear hub 90.

Figure 32:
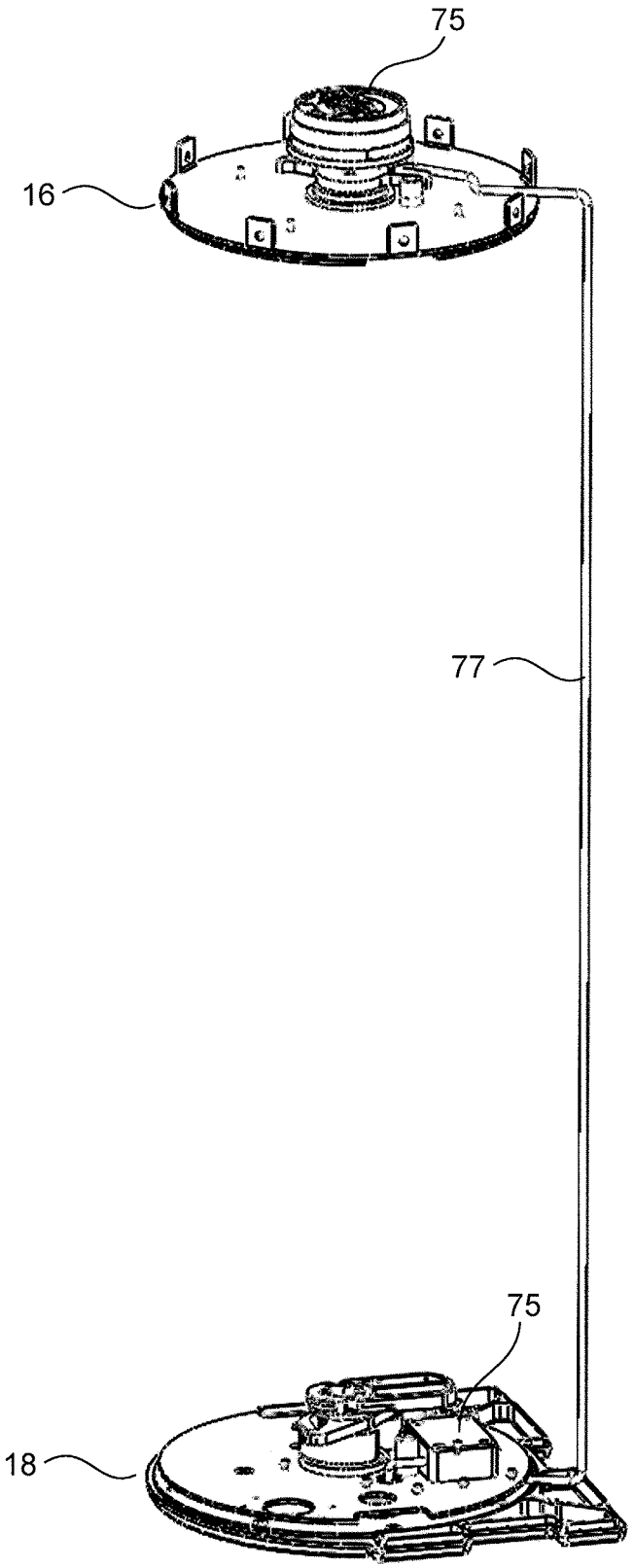
FIG. 32 depicts an exemplary wiring conductor extending from the keypad to the lower locking mechanism.

A wiring conductor 77 extends from an output in the keypad 75 to the lock body 96. As shown in FIG. 32, the wiring conductor 77 extends from the keypad 75 in the top assembly 16 to the lock body 96 disposed in the lower assembly 18. The wiring conductor is of sufficient length and gage and has a suitable conductor to transmit signals from the keypad 75 to the lock body 96 in the lower locking mechanism 80 to activate and deactivate the locking mechanism 80 disposed in the lower assembly 18.

FIGS. 21-22 illustrate the operation of the lower locking mechanism 80. When the lock body 96 is electronically actuated to lock the lower assembly 18 to prevent the rotatable housing 30 from being rotated, the projection or end or lock nose 97 extends out of the lock body 96 causing a projection or nose 100*a* extending from the circular central body of the sear lock 100 to pivot and move into the locking notched indentation 90*b* of the sear hub 90 thereby preventing the sear hub 90 from being rotated. The sear hub 90 will remain rotationally locked in the closed locked position until the lock body 96 is electronically released so that the nose 100*a* extending from the sear lock 100 is retracted and moved away from the locking notched indentation 90*b*. When the sear hub 90 is locked, the entire rotatable housing 30 is prevented from being rotated and suspended in a closed locked position as shown in FIG. 21.

When the sear hub 90 is unlocked by the sear lock 100, the rotatable housing 30 is allowed to rotate into an open unlocked position such as shown in FIG. 22. As shown, the sear lock 100 is unlocked from the sear hub 90 when the lock nose 97 is actuated to retract back into the lock body 96 and the nose 100*a* of the sear lock 100 is retracted from within the notched indentation 90*b* in the sear hub 90. When the sear hub 90 is unlocked, the entire rotatable housing 30 is allowed to rotate as depicted in FIG. 24. As shown in FIG. 24, the first and vertical frame member 41 and the second vertical frame member 42 are rotated 180 degrees from their initial position shown in FIG. 21.

The lock body 96 may be actuated by a variety of different actuating mechanisms, such as by a mechanical switch, an electronic switching mechanism and/or any other suitable actuation method. An electronic keypad can be positioned on the handle assembly 60 and an electrical conductor can be extended from the keypad to the lock body 96 in order to activate and deactivate the locking and unlocking of the lock body 96.

Referring back to FIG. 23, the lower locking mechanism 80 includes a lower locking mount 94 provided just above the lower floor plate 110. The lower locking mount 94 is adapted to be connected to the lower weapons cassette mount 47.

Figure 25:
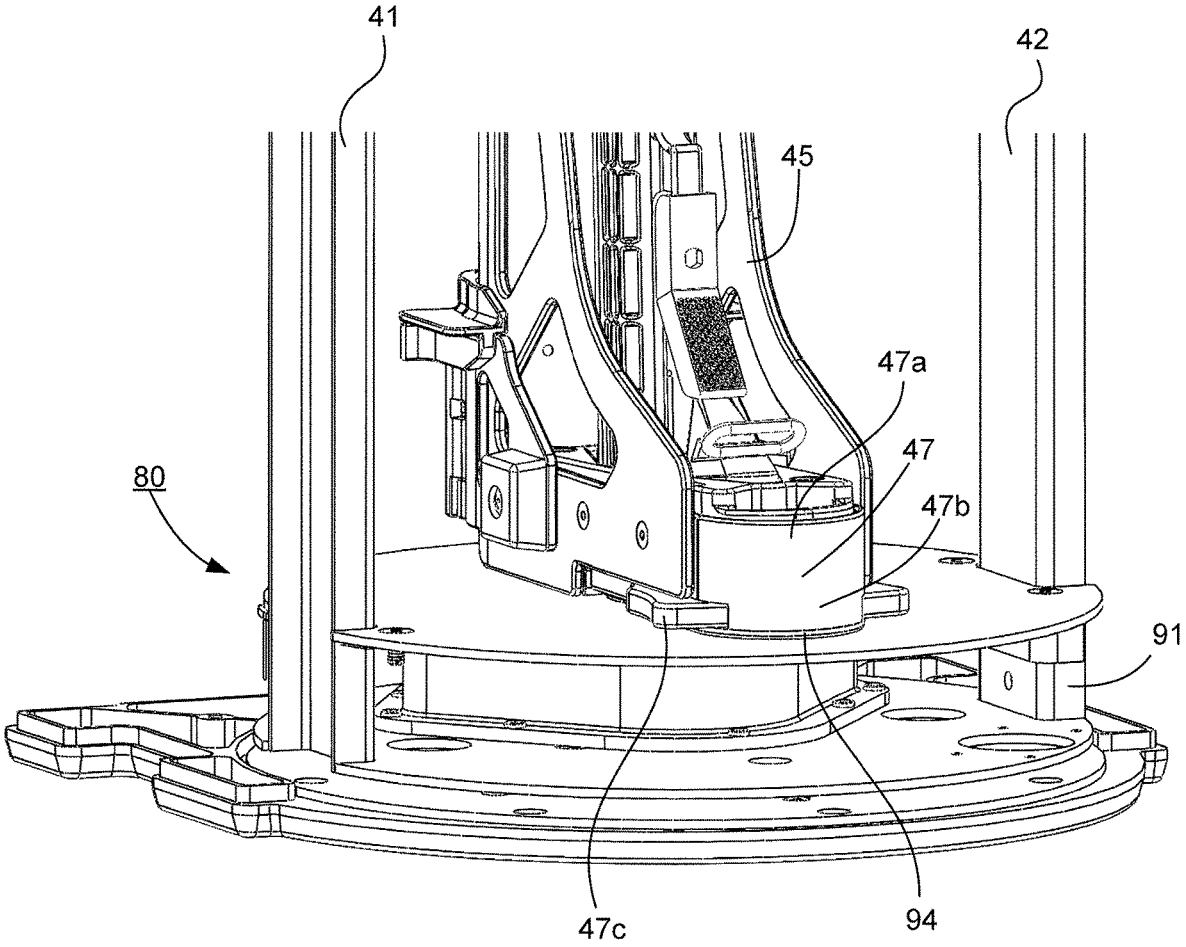
FIG. 25 illustrates a side view of the lower locking mechanism in a locked closed position.

FIG. 25 shows a side view of the lower locking mount 94 connected to the lower weapons cassette mount 47 that is attached to the weapons cassette 45. The rotating door 31 is shown cut away to illustrate the interior compartment 34 of the rotatable housing 30. In use, the weapons cassette 45 is fixed and does not rotate as the rotatable housing 30 rotates between the unlocked position as shown in FIG. 22 and the locked position shown in FIG. 21.

The lower weapons cassette mount 47 is positioned at the lower end of the weapons cassette 45 and is adapted to engage and lock onto the lower locking mount 94 attached to the lower assembly 18 of the rotatable housing 30. The lower weapons cassette mount 47 of the weapons cassette 45 may be provided with various engagement configurations to lock onto the lower locking mount 94. For example, the lower weapons cassette mount 47 may have a receiving cup portion 47*a* with an outer guide 47*b* portion adapted to receive and align the lower locking mount 94 within the outer guides 47*b*. A pair of release levers 47*c* may be integrated into the lower weapons cassette mount 47 and function as latch release levers to release the lower locking mount 47 of the weapons cassette 45 in a quick manner when the release levers 47*c* are depressed.

Figure 26:
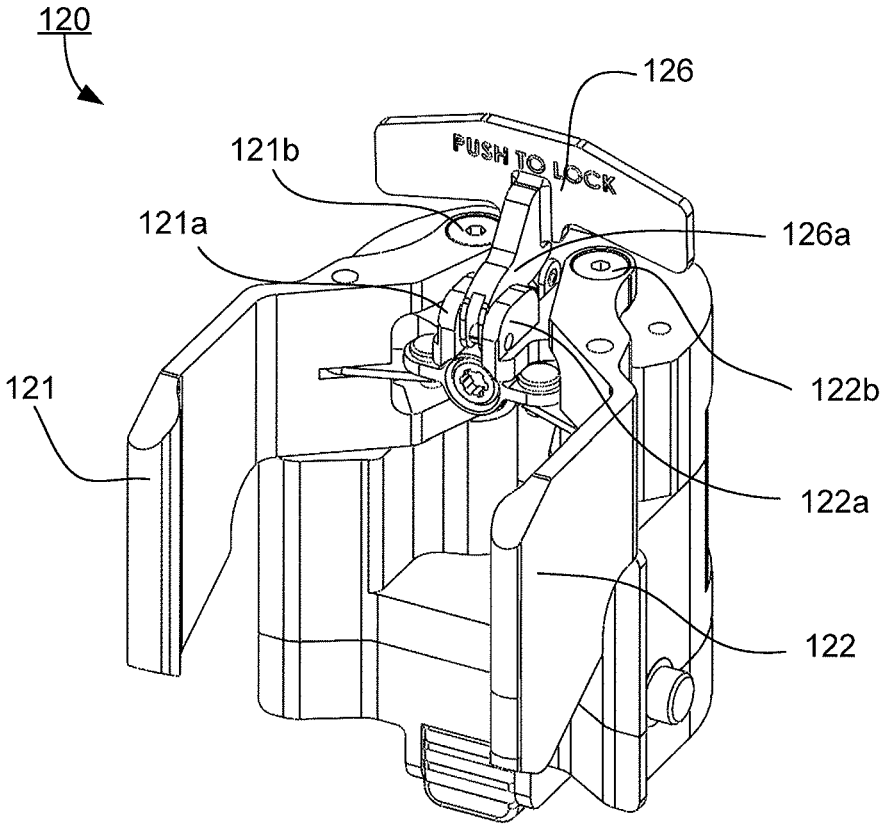
FIG. 26 shows the barrel locking mechanism.
Figure 27:
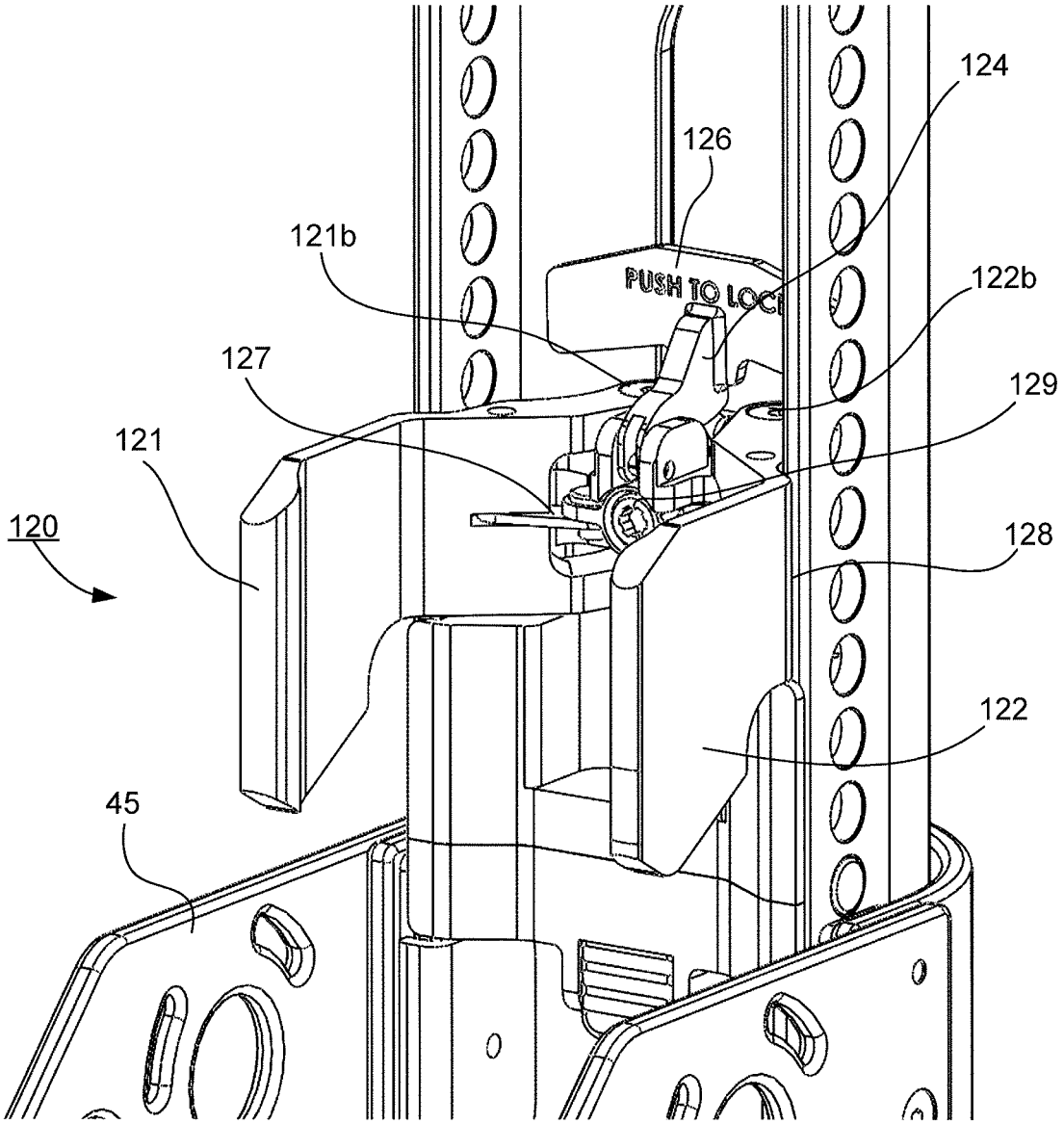
FIG. 27 shows the barrel locking mechanism attached to the weapons cassette.

FIG. 26 depicts the weapon clamp 120, and FIG. 27 illustrates the weapons clamp secured to the weapons cassette 45. The weapon clamp 120 can be constructed in variety of different ways. This embodiment includes the clamp 120 having a first jaw 121 and a second jaw 122 adapted to move open and close. The clamp 120 may include an interior resilient grip portion composed of a flexible material that can be slightly compressed as the clamping force is applied during the closure process of the clamp 120. The first jaw 121 may pivot outward at a first pivot connection 121*b* and the second jaw 122 may pivot outward at a second pivot connection 122*b*.

The clamp 120 may be opened and closed by a lever 126 having a cam surface 126*a* that engages with mating cam surfaces 121*a*, 122*a* attached to the jaws 121, 122 to open and close the jaws 121, 122 based on the position of the lever 126 and its cammed surface 126*a* biasing against the cammed surfaces 121*a* of the first jaw 121 and the cammed surface 122*a* of the second jaw 122.

Figure 28:
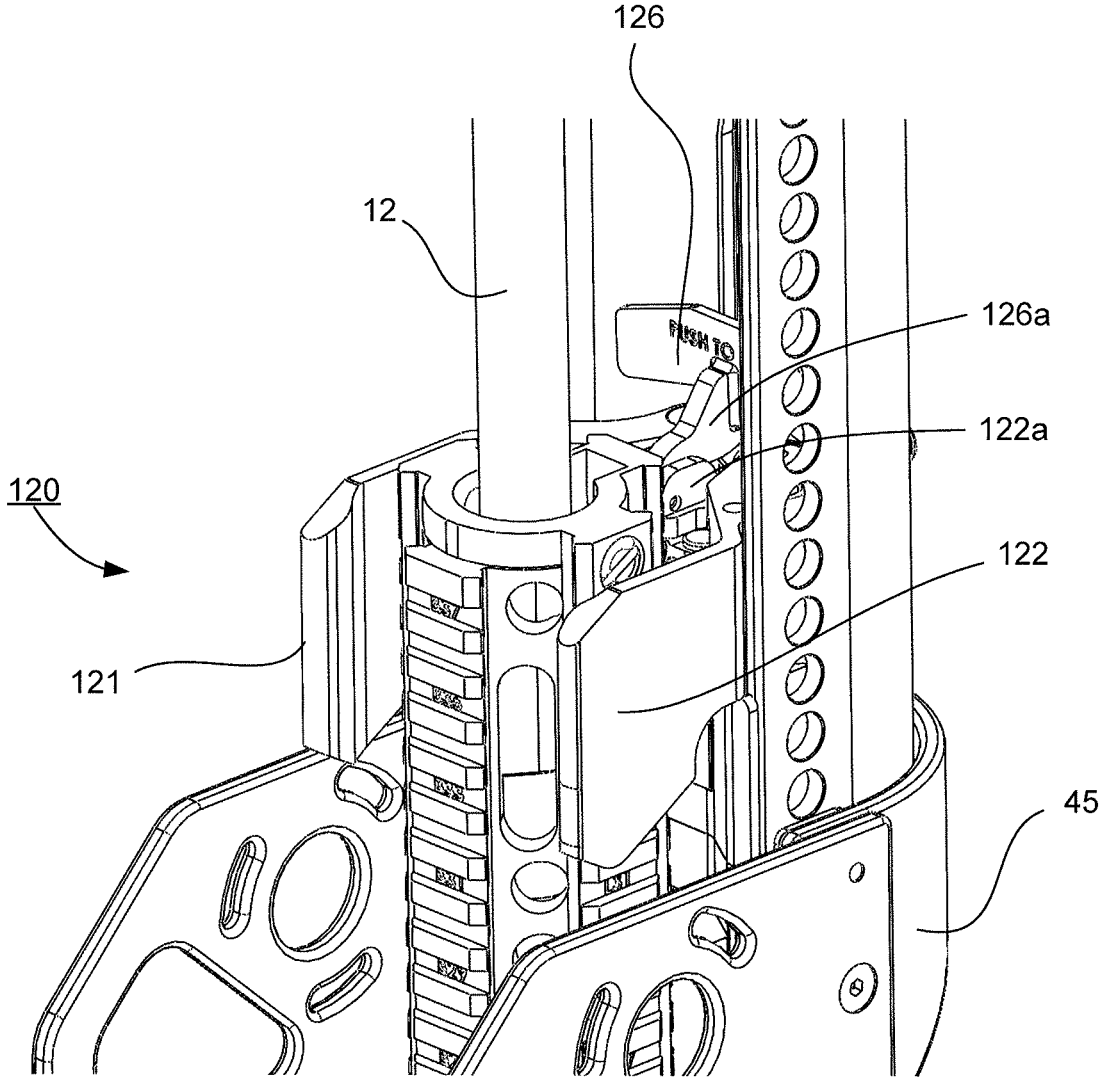
FIG. 28 shows the barrel locking mechanism securing a barrel of a weapon.

In FIGS. 27-28, the weapon clamp 120 is shown disposed on the weapon cassette 45 and is positioned adjacent to a barrel of a weapon 12. In use, the jaws 121, 122 are secured by the clamp 120 onto the barrel of the weapon 12 in such a way, and with a force, that the weapon cannot be removed without opening the clamp 120. Although shown attached to the barrel of a weapon, it is to be understood that the weapons clamp 120 can be constructed to clamp onto any portion of a weapon according to this subject disclosure.

Figure 29:
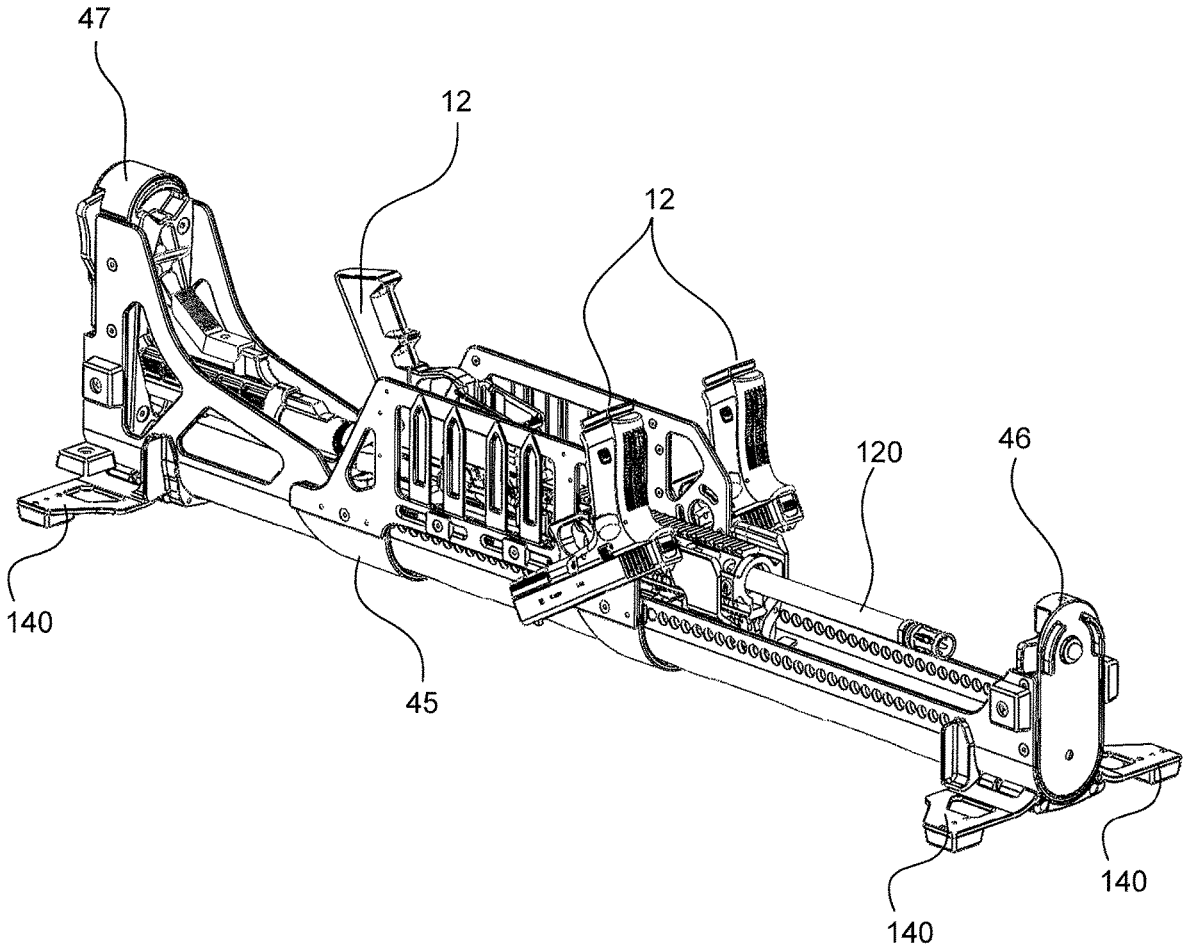
FIG. 29 shows the barrel locking mechanism securing a rifle to the weapons cassette.
Figure 30:
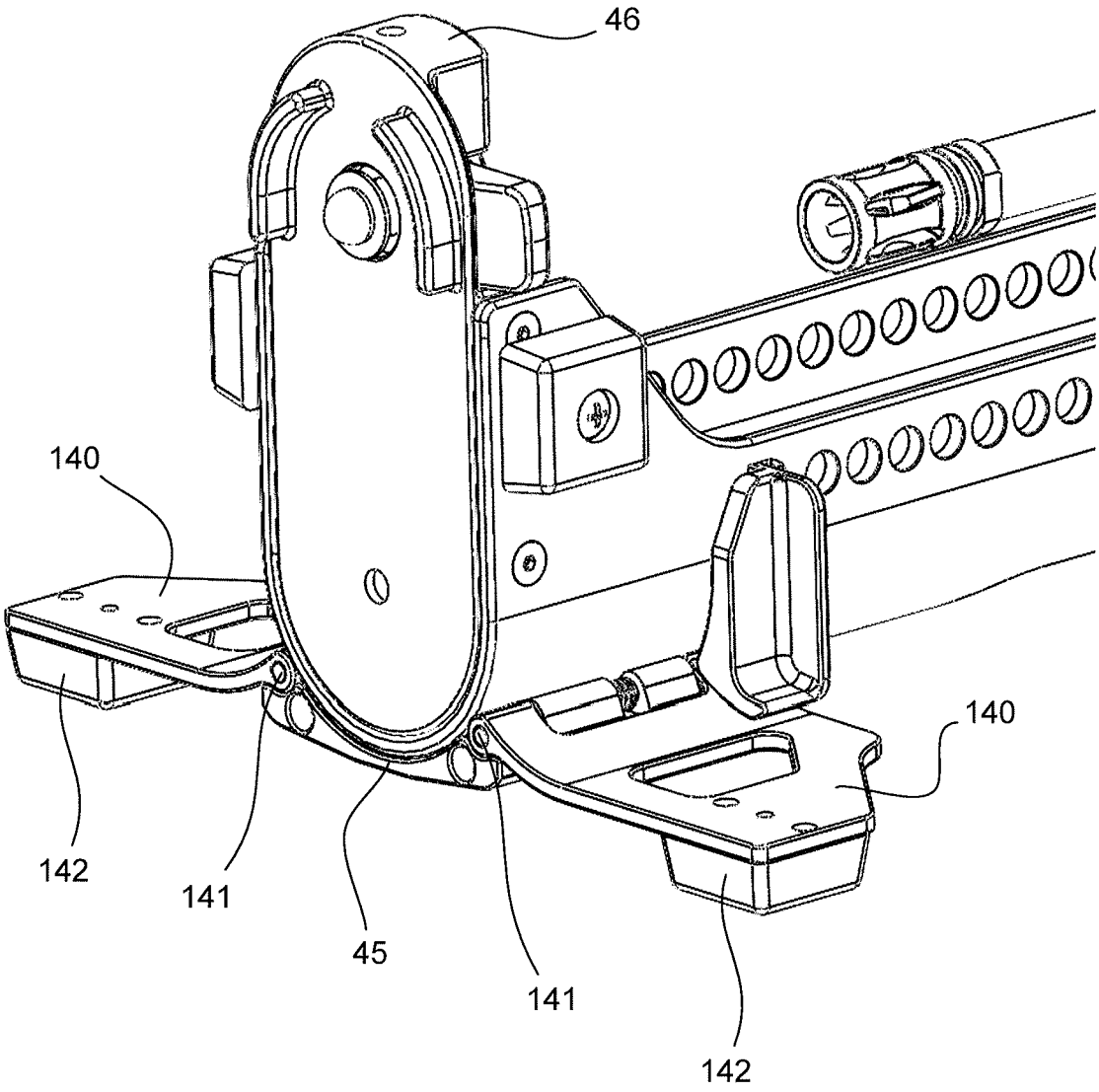
FIG. 30 shows retractable feet adapted for use with the weapons cassette.

FIGS. 29-30 shows retractable feet 140 adapted for use with the weapons cassette 45. The retractable feet 140 are provided to enable the weapons cassette to sit upright in a stable secure manner when the weapon cassette is laid onto a surface. The retractable feet 140 pivot inward adjacent to the cassette when in a storage position and outward into an open position as shown in FIG. 29 to widen the footprint of the weapons cassette. Resilient pads 142 may be provided at the ends of the feet 140 for enhanced support and stability.

Figure 31:
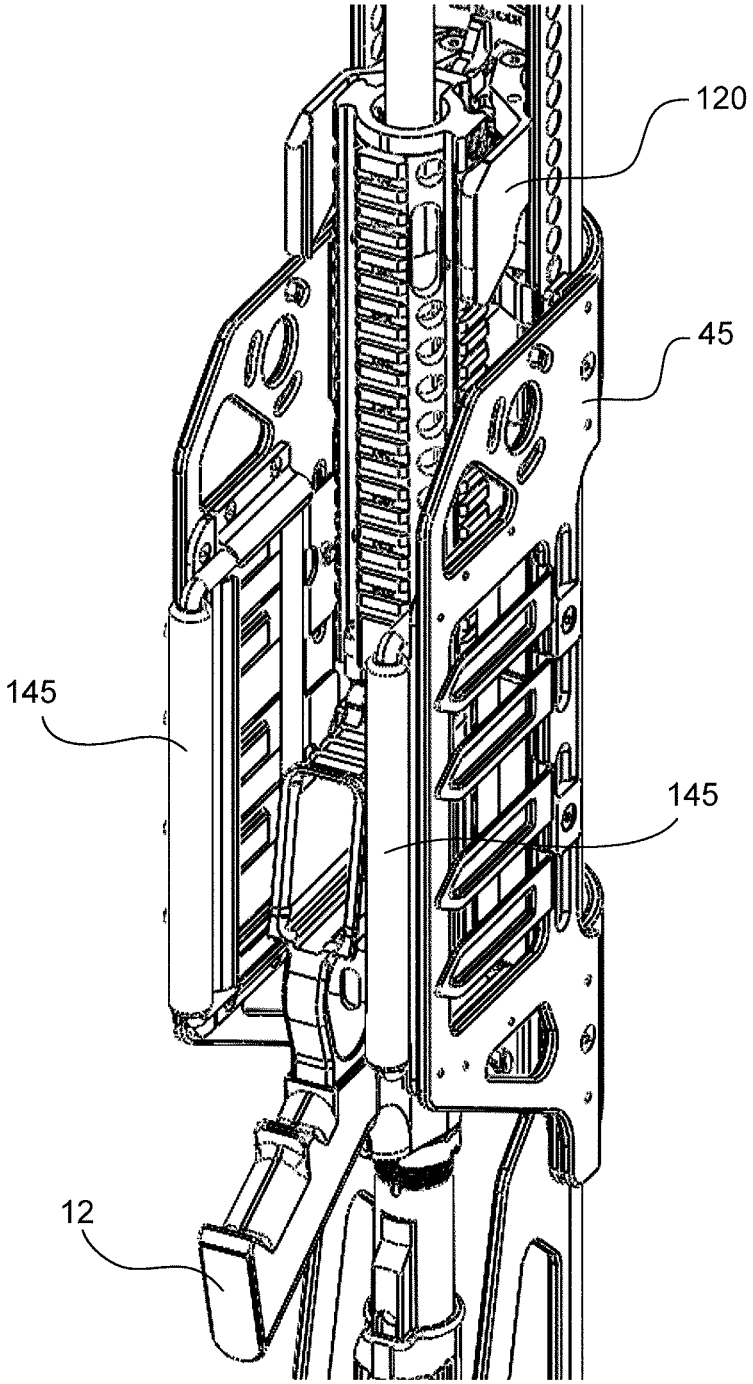
FIG. 31 shows an enlarged view of the weapons cassette including a pair of retractable handles.

FIG. 31 shows an enlarged view of the weapons cassette 45 including a pair of retractable handles 145. The retractable handles 145 make it easier to transport the weapons cassette 45 during transport. A user can gain a better grip on the weapons cassette 45 by using the retractable handles 145.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention.

For example, the locking mechanism may be used for a variety of different applications outside of the weapons storage system technology, such as for example for use with secure enclosures for jewelry, currency and/or other personal effects. It is understood therefore that the invention is not limited to the particular embodiment which is described, but is intended to cover all modifications and changes within the scope and spirit of the invention.

What is claimed:

1. A storage system for securing a weapon or valuable item comprising:

an outer housing assembly comprising an elongated housing having a non-rotatable curved inner structure;

an arcuate housing door; and a handle assembly that rotates the arcuate housing door concentrically about a longitudinal axis and partially within and adjacent to the non-rotatable curved inner structure, wherein a rotational pivot of the handle assembly is aligned with the longitudinal axis and rotates the arcuate housing door about the longitudinal axis between:

a closed position that prevents access to an internal compartment within the elongated housing, and an open position that provides an access opening of approximately 180 degrees about the longitudinal axis into the internal compartment within the elongated housing wherein the handle assembly is connected to at least one of a first curved end or a second curved end of the arcuate housing door and adapted to rotate the arcuate housing door between the closed position and the open position adjacent to the non-rotatable curved inner structure of the elongated housing.

2. The storage system for securing a weapon or valuable item recited in claim 1, wherein the handle assembly further comprises:

a central opening adapted to receive a keypad into which an access code can be input; and a locking mechanism provided in the storage system adapted to prevent rotation or permit rotation of the arcuate housing door in a locked position or an unlocked position respectively, where, in a locked position, the locking mechanism prevents the arcuate housing door from rotating into the open position.

3. The storage system for securing a weapon or valuable item recited in claim 2, wherein the locking mechanism is electronically actuated to unlock the locking mechanism when the access code is inserted correctly.

4. The storage system for securing a weapon or valuable item recited in claim 2, wherein the handle assembly is attached to a stop plate that rotates and is concentrically fixed to a main shaft, the stop plate has a first arm that engages a stop shaft in the locked position, and a second arm that engages the stop shaft in the unlocked position.

5. The storage system for securing a weapon or valuable item recited in claim 4, wherein the stop shaft defines the 180 degree boundary between which the handle assembly rotates between the locked position and unlocked position.

6. The storage system for securing a weapon or valuable item recited in claim 1, further comprising:

a mount for receiving the weapon or valuable item; and the arcuate housing door including a lower floor plate positioned below the mount and rotatable around the mount.

7. The storage system for securing a weapon or valuable item recited in claim 1, wherein the storage system further comprises:

a removable cassette that is disposed within the internal compartment of the elongated housing, wherein when the handle assembly and the arcuate housing door are rotated together between the closed position and the open position, the removable cassette remains fixed and does not rotate within the internal compartment of the elongated housing.

8. The storage system for securing a weapon or valuable item recited in claim 1, wherein the arcuate housing door is semicircular and is attached between the first curved end and the second curved end of the non-rotatable curved inner structure of the elongated housing, wherein the arcuate housing door is positioned within the non-rotatable curved inner structure of the elongated housing, and wherein the arcuate housing door extends semicircular a predetermined distance to completely cover the access opening bounded by the elongated housing.

9. The storage system for securing a weapon or valuable item recited in claim 2, wherein the locking mechanism has an electronic actuated lock that is controlled by the keypad, wherein the keypad is located remote from the locking mechanism in the outer housing assembly.

10. The storage system for securing a weapon or valuable item recited in claim 2, wherein the locking mechanism is sealed in at least one of:

an upper top assembly, or a lower assembly within the elongated housing, the locking mechanism being bounded by the lower floor plate of the arcuate housing door and a floor plate provided at a bottom of the elongated housing.

11. A storage system for securing a weapon or valuable item comprising:

an outer housing assembly comprising:

an elongated housing having a non-rotatable curved inner structure;

an arcuate housing door; and a handle assembly having a central opening adapted to house a keypad into which an access code can be input to unlock the arcuate housing door, wherein when the arcuate housing door is unlocked, the arcuate housing door rotates concentrically about a longitudinal axis and partially within and adjacent to the non-rotatable curved inner structure, and wherein the handle assembly rotates the arcuate housing door between:

a closed position that prevents access to an internal compartment within the elongated housing; and an open position that provides an access opening of approximately 180 degrees about the longitudinal axis into the internal compartment within the elongated housing.

12. The storage system for securing a weapon or valuable item recited in claim 11, further comprising:

a mount for receiving the weapon or valuable item, wherein the arcuate housing door includes a lower floor plate positioned below the mount and rotatable around the mount; and a locking mechanism provided in the elongated housing that prevents rotation or permits rotation of the arcuate housing door into a locked position or an unlocked position respectively, where, in the locked position, the locking mechanism prevents the arcuate housing door from rotating into the open position.

13. The storage system for securing a weapon or valuable item recited in claim 12, wherein the locking mechanism has an electronic actuated lock that is controlled by the keypad when an access code is inserted correctly, wherein the keypad is located remote from the locking mechanism in the outer housing assembly.

14. The storage system for securing a weapon or valuable item recited in claim 12, wherein the locking mechanism is sealed in at least one of:

an upper top assembly, or a lower assembly within the elongated housing, the locking mechanism being bounded by the lower floor plate of the arcuate housing door and a floor plate provided at a bottom of the elongated housing.

15. The storage system for securing a weapon or valuable item recited in claim 12, wherein the arcuate housing door further comprises:

an inner circular base;

an inner circular top; and a pair of columns connected to the inner circular base and the inner circular top, wherein the arcuate housing door is connected between the inner circular base and the inner circular top.

16. The storage system for securing a weapon or valuable item recited in claim 11, wherein the storage system further comprises:

a removable cassette that is disposed within the internal compartment of the elongated housing, wherein when the handle assembly and the arcuate housing door are rotated together between the closed position and the open position, the removable cassette remains fixed and does not rotate within the internal compartment of the elongated housing.

17. A storage system for securing a weapon or valuable item, comprising:

an outer housing comprising:

an elongated housing having a non-rotatable curved inner structure;

an arcuate housing door;

a handle assembly having a central opening adapted to house a keypad into which an access code can be input; and a locking mechanism provided in the storage system adapted to prevent rotation or permit rotation of the arcuate housing door in a locked position or an unlocked position respectively, wherein the handle assembly rotates the arcuate housing door concentrically about a longitudinal axis within and adjacent to the non-rotatable curved inner structure, the arcuate housing door rotates between a locked position to prevent access to an internal compartment within the elongated housing, and an unlocked position to permit an access opening of approximately 180 degrees about the longitudinal axis into the internal compartment.

18. The storage system for securing a weapon or valuable item recited in claim 17, wherein the locking mechanism has an electronic actuated lock that is controlled by the keypad, wherein the keypad is located remote from the locking mechanism in an outer housing assembly.

19. The storage system for securing a weapon or valuable item recited in claim 17, wherein the locking mechanism is sealed in at least one of:

an upper top assembly, or a lower assembly within the elongated housing, the locking mechanism being bounded by a lower floor plate of the arcuate housing door and a floor plate provided at a bottom of the elongated housing.

* * * * *